US007142182B2

(12) United States Patent
Aoki et al.

(10) Patent No.: US 7,142,182 B2
(45) Date of Patent: Nov. 28, 2006

(54) IMAGE PROCESSING CIRCUIT, IMAGE PROCESSING METHOD, ELECTRO-OPTICAL DEVICE, AND ELECTRONIC APPARATUS

(75) Inventors: Toru Aoki, Shiojiri (JP); Keijiro Naito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 585 days.

(21) Appl. No.: 10/050,831

(22) Filed: Jan. 18, 2002

(65) Prior Publication Data

US 2002/0097236 A1 Jul. 25, 2002

(30) Foreign Application Priority Data

Jan. 24, 2001 (JP) ..... 2001-016185

(51) Int. Cl.
*G09G 3/36* (2006.01)

(52) U.S. Cl. ..... 345/87; 345/89; 345/98; 345/100; 345/204; 345/211; 345/212; 345/690

(58) Field of Classification Search ..... 345/204, 345/99, 98, 97, 100, 87, 96, 89, 690, 211–214, 345/78; 348/537
See application file for complete search history.

(56) References Cited

U.S. PATENT DOCUMENTS 5,528,307 A * 6/1996 Owada et al. ..... 348/497
5,926,174 A * 7/1999 Shibamiya et al. ..... 345/213
5,990,968 A * 11/1999 Naka et al. ..... 348/537
5,995,072 A 11/1999 Nakajima
6,452,526 B1 * 9/2002 Sagawa et al. ..... 341/144
6,462,735 B1 * 10/2002 Naito ..... 345/204
6,538,648 B1 * 3/2003 Koike et al. ..... 345/213
6,724,381 B1 * 4/2004 Sakashita ..... 345/213

FOREIGN PATENT DOCUMENTS

| | | | |
|---|---|---|---|
| JP | A 63-235995 | | 9/1988 |
| JP | 05-153435 | * | 6/1993 |
| JP | A 05-281926 | | 10/1993 |
| JP | A 09-081080 | | 3/1997 |
| JP | A 2000-105363 | | 4/2000 |
| JP | A 2000-172218 | | 6/2000 |

* cited by examiner

*Primary Examiner*—Richard Hjerpe
*Assistant Examiner*—Jennifer T. Nguyen
(74) *Attorney, Agent, or Firm*—Oliff & Berridge, PLC

(57) ABSTRACT

The present invention provides an image processing circuit having a D/A converter that converts input image data Da to an analog signal to generate an image signal VID. The output range of the D/A converter is controlled by an output-range control signal CTLout having a different signal level according to the type of a liquid-crystal display panel used. Therefore, a range where the signal level of the image signal VID is changed can be adjusted according to the type of the liquid-crystal display panel. Consequently, even when an image-signal processing circuit is used with one of a plurality of types of liquid-crystal display panels having different V-T characteristics, since the data values of input image data Da can be assigned to a desired applied-voltage range, high-definition images can be displayed.

12 Claims, 26 Drawing Sheets

(a)

(b)

(a)

(b)

(a)

(b)

IMAGE PROCESSING CIRCUIT, IMAGE PROCESSING METHOD, ELECTRO-OPTICAL DEVICE, AND ELECTRONIC APPARATUS

BACKGROUND OF THE INVENTION

1. Field of Invention

The present invention relates to image processing circuits and image processing methods suited to be used for electro-optical devices having electro-optical materials in which transmittances are changed according to an applied voltage. The present invention also relates to electro-optical apparatus using the circuits and/or the methods, and relates to electronic units.

2. Description of Related Art

Conventional electro-optical devices will be described below by taking an active-matrix liquid-crystal display device as an example by referring to FIG. 27. The liquid-crystal display device can be formed of a liquid-crystal display panel 100, a timing circuit 200, and an image-signal processing circuit 300.

The liquid-crystal display panel 100 is structured such that liquid crystal is sandwiched by a device substrate and an opposite substrate. The device substrate has a plurality of data lines and a plurality of scanning lines, and thin-film transistors (hereinafter called TFTs) disposed at the intersections thereof, serving as switching devices. Since liquid crystal has a characteristic in which its transmittance is changed according to an applied voltage, a desired gray scale can be displayed by controlling turning on and off of the TFTs.

The timing circuit 200 outputs timing signals used in sections. A D/A conversion circuit 301' in the image-signal processing circuit 300 converts input image data D sent from an external unit, from a digital signal to an analog signal to output as an image signal VID. A phase-development circuit 302 ' develops an input one-phase image signal VID to N-phase (N=6 in the figure) phase-development image signals and outputs them. The reason whey the image signal is developed to the N-phase signals is to extend a time in which an image signal is applied to TFTs to obtain a sufficient sampling time and a sufficient charging and discharging time of data signals sent through the data lines.

An amplification and inversion circuit 303' inverts the polarities of the phase-development image signals in the following condition, and outputs output phase-development image signals VID1 to VID6 in which amplitude levels are adjusted according to the V-T characteristic (characteristic of transmittance against applied voltages), to the liquid-crystal display panel 100. The polarities of the output phase-development image signals are inverted such that the voltage levels of the signals are alternately inverted with the center voltages of the amplitudes of the signals being used as reference potentials.

The display performance of such a liquid-crystal display apparatus can be indicated by indexes such as a contrast ratio and a change in transmittance per gradation. The contrast ratio is a value obtained by dividing the maximum transmittance of the liquid crystal by the minimum transmittance. The larger the contrast ratio is, the larger the contrast of a displayed image is. The smaller the change in transmittance per gradation is, the higher-definition display is possible.

SUMMARY OF THE INVENTION

However, the conventional image-signal processing circuit 300 has the following problems since the data values of the input image data D and the signal levels of the output phase-development image signals VID1 to VID6 have a one-to-one correspondence.

Accordingly, there is a prerequisite that the conventional image-signal processing circuit 300 should be used in combination with the predetermined liquid-crystal display panel 100. When the image-signal processing circuit 300 is used with another liquid-crystal display panel having a different V-T characteristic, a quantization error becomes large and a high-definition image cannot be displayed.

It is assumed here, for example, that the input image data has 10 bits, the liquid-crystal display panel 100 has a V-T characteristic shown in FIG. 28(*a*), and the image-signal processing circuit 300 generates output phase-development image signals VID1 to VID6 so as to obtain the maximum contrast ratio and the minimum change in transmittance per gradation.

In this V-T characteristic, the transmittance rapidly changes in a range of applied voltages Vw1 to Vb1, and the transmittance is saturated when an applied voltage is Vw1 or less, or Vb1 or more. The image-signal processing circuit 300 generates the output phase-development image signals VID1 to VID6 such that a voltage applied to the liquid crystal is changed from Vb1 to Vw1 when the data value of the input image data is changed from "0" to "1023" in order to make the contrast ratio maximum and make the change in transmittance per gradation minimum. In this case, the change in transmittance per dot is 90/1024.

A case in which a liquid-crystal display panel 100 having a V-T characteristic shown in FIG. 28(*b*) is used in combination with the image-signal processing circuit 300, instead of the liquid-crystal display panel 100 having the V-T characteristic shown in FIG. 28(*a*), will be examined next. In the V-T characteristic shown in FIG. 28(*b*), transmittance rapidly changes in a range of applied voltages Vw2 to Vb2. The image-signal processing circuit 300 is adjusted such that a voltage applied to the liquid crystal is changed from Vb1 to Vw1 when the value of input image data is changed from 0 to 1023. Therefore, when the value of input image data is 170, a voltage applied to the liquid crystal is Vb2, and when the value of input image data is 853, a voltage applied to the liquid crystal is Vw2. Since the transmittance is saturated in the V-T characteristic when the applied voltage is Vw2 or less or Vb2 or more, even if the applied voltage is changed in these ranges, the transmittance is not changed. In other words, the transmittance is changed when the value of input image data is within an effective range of 170 to 853. In this case, a change in the transmittance per bit is 90/683.

Therefore, when the liquid-crystal display panel 100 having the V-T characteristic shown in FIG. 28(*b*) is used in combination with the image-signal processing circuit 300, the change in the transmittance per bit is about 3/2 times as large as that obtained when the liquid-crystal display panel 100 having the V-T characteristic shown in FIG. 28(*a*) is used in combination with the image-signal processing circuit 300. In addition, a quantization error becomes larger and high-definition images cannot be displayed. In other words, the conventional image-signal processing circuit 300 needs to be used in combination with a single liquid-crystal display panel, and lacks flexibility.

The input image data D sent from the outside may be so-called computer graphics created digitally by a computer or may be a signal obtained by applying A/D conversion to a video signal captured by a video camera. When the input image data is computer graphics, a luminance level is high and intermediate-gradation areas are small, in general. When the input image data is made from a video signal, intermediate-gradation areas are large. The input image data D is unbalanced in its values according to its type, namely, according to how the data is formed.

Since processing based on the type of the input image data D is not performed, and uniform processing is conducted in the conventional image-signal processing circuit 300, a high-definition display suited to the nature of the input image data cannot be performed.

When the input image data D is based on a video signal, the input image data D is unbalanced in its data values depending on a capturing condition. For example, data values are biased to high luminance in a day-time seaside scene, data values are biased to intermediate gradations in an indoor scene, and data values are biased to low luminance in a scene taken at a road after dark.

Since processing based on the type of the input image data D is not performed, and uniform processing is conducted in the conventional image-signal processing circuit 300, a high-definition display suited to the data values of the input image data cannot be performed.

Accordingly, the present invention has been made in consideration of the foregoing conditions. It is an object of the present invention to provide an image processing circuit, an image processing method, an electro-optical apparatus, and an electronic unit which provide high flexibility and allow high-definition image display.

To achieve the foregoing object, an image processing circuit of the present invention can include a control-signal generating device that generates a control signal indicating the type of an electro-optical panel used in combination with the image processing circuit, a D/A conversion device that converts input image data from a digital signal to an analog signal to generate an image signal and for adjusting a range where the signal level of the image signal is changed, according to the control signal, and a processing device that generates an output image signal to be sent to the electro-optical panel, according to the image signal.

The transmittance of an electro-optical material is determined by an applied voltage, and the transmittance is saturated at a certain applied voltage. Therefore, to make a contrast ratio maximum and make a change in transmittance per gradation minimum, it is necessary to assign the data values of input image data to an applied-voltage range from an applied voltage which makes the transmittance maximum to an applied voltage which makes the transmittance minimum. According to the present invention, since a range in which the signal level of the image signal is changed can be adjusted according to the type of an electro-optical panel used, a range of an applied voltage applied to the electro-optical material can be adjusted according to its V-T characteristic (characteristic of transmittance against applied voltages). As a result, even when the image processing circuit is used in combination with various types of electro-optical panels, high-definition images can be displayed at a high contrast, and panel performance can always be drawn as much as possible.

In the above-described image processing circuit, it is preferred that the processing device include an image-signal inversion section for inverting the signal polarity of the image signal at an inversion period determined in advance, with a certain potential being used as a reference while amplifying the image signal to generate an inverted image signal, a reference-signal generating section for generating a first reference voltage and a second reference voltage according to the control signal, and for alternately selecting one of the first reference voltage and the second reference voltage at the inversion period to generate a reference signal, and an output-image-signal generating section for synthesizing the inverted image signal with the reference signal to generate the output image signal. According to the present invention, since the first reference voltage and the second reference voltage can be generated according to the type of an electro-optical panel, the output image signal can be generated according to the V-T characteristic of the electro-optical panel that is being used in combination. In addition, when the reference potential is sent to one electrode and the output image signal is sent to the other electrode, the electrodes sandwiching the electro-optical material, the polarity of an applied voltage applied to the electro-optical material can be inverted.

It is preferred that the reference-signal generating section include a power-supply section for generating a positive-polarity reference voltage higher than a reference potential determined in advance according to the type of the electro-optical panel, by a minimum applied voltage, and for generating a negative-polarity reference voltage lower than the reference potential by the minimum applied voltage. Additionally, a first selection section for selecting a voltage corresponding to the electro-optical panel can be used in combination with the image processing circuit among the positive-polarity reference voltages, according to the control signal to generate the first reference voltage, and for selecting a voltage corresponding to the electro-optical panel used in combination with the image processing circuit among the negative-polarity reference voltages, according to the control signal to generate the second reference voltage. Further, a second selection section for alternately selecting one of the first reference voltage and the second reference voltage at the inversion period to generate the reference signal and the minimum applied voltage be specified for each electro-optical panel, and be the lowest voltage required to be applied to the electro-optical material of the electro-optical panel to obtain a range of transmittance used for displaying images. In addition, it is preferred that the minimum applied voltage be a voltage corresponding to the saturation transmittance of the electro-optical material.

Furthermore, the image processing circuit may be configured such that the power-supply section used in the reference-signal generating section includes a first voltage source for generating a first voltage higher than a reference potential determined in advance according to the type of the electro-optical panel, by a maximum applied voltage, a second voltage source for generating a second voltage lower than the reference potential by the maximum applied voltage, a subtraction section for subtracting a change voltage determined in advance according to the type of the electro-optical panel from the first voltage to generate the positive-polarity reference voltage, and an adder section for adding the change voltage to the second voltage to generate the negative-polarity reference voltage. The maximum applied voltage is the highest voltage required to be applied to the electro-optical material to obtain a range of transmittance used for displaying images, according to the type of the electro-optical panel. According to the present invention, when the electro-optical panel operates in a normally white mode, the first voltage at the positive side corresponding to a black level and the second voltage at the negative side are first generated with AC driving being taken into consideration, and then, the change voltage is subtracted and added to obtain the positive-polarity reference voltage and the negative-polarity reference voltage.

An image processing circuit according to the present invention can include a control-signal generating device that generates a control signal indicating the type of input image data, a data conversion device that converts the data values of the input image data to data values related thereto in advance, according to the control signal to generate converted image data, a D/A converter that converts the converted image data from a digital signal to an analog signal to generate an image signal and for adjusting a range where the signal level of the image signal is changed, according to the control signal, and processing device that generates an output image signal to be sent to an electro-optical panel, according to the image signal.

In the input image data, data values have unbalanced occurrence frequencies according to the type of the input image data. This means that the electro-optical material to be controlled has an unbalanced transmittance according to the type of the input image data. According to the present invention, converted image data can be generated according to the type of the input image data while a range where the signal level of the image signal is changed can be adjusted according to the type of the input image data. Therefore, a range of applied voltages to which data values are assigned can be changed according to the type of the input image data. Consequently, high-definition images can be displayed.

It is preferred that the processing device includes an image-signal inversion section for inverting the signal polarity of the image signal at an inversion period determined in advance, with a certain potential being used as a reference while amplifying the image signal to generate an inverted image signal, a reference-signal generating section for generating a first reference voltage and a second reference voltage which are set to voltage values corresponding to the type of the input image data, according to the control signal, and for alternately selecting one of the first reference voltage and the second reference voltage at the inversion period to generate a reference signal, and an output-image-signal generating section for synthesizing the inverted image signal with the reference signal to generate the output image signal. According to the present invention, since the first reference voltage and the second reference voltage can be generated according to the type of the input image data, the output image signal can be generated according to the occurrence frequencies of data values, which are different depending on the type. In addition, when the reference voltage is applied to one electrode and the output image signal is applied to the other electrode, the electrodes sandwiching the electro-optical material, the polarity of an applied voltage applied to the electro-optical material can be inverted, and the electro-optical material can be AC-driven.

It is preferred that the reference-signal generating section include a power-supply section for generating a positive-polarity reference voltage higher than a reference potential determined in advance according to the type of the input image data, by a minimum applied voltage, and for generating a negative-polarity reference voltage lower than the reference potential by the minimum applied voltage, a first selection section for selecting a voltage corresponding to the type of the input image data among the positive-polarity reference voltages according to the control signal to generate the first reference voltage, and for selecting a voltage corresponding to the type of the input image data among the negative-polarity reference voltages according to the control signal to generate the second reference voltage, and a second selection section for alternately selecting one of the first reference voltage and the second reference voltage at the inversion period to generate the reference signal. The minimum applied voltage being the lowest voltage required to be applied to the electro-optical material of the electro-optical panel to obtain a range of transmittance used for displaying images for each type of the input image data.

It is preferred that the power-supply section of the reference-signal generating section include a first voltage source for generating a first voltage higher than a reference potential determined in advance according to the type of the input image data, by a maximum applied voltage, a second voltage source for generating a second voltage lower than the reference potential by the maximum applied voltage, a subtraction section for subtracting a change voltage determined in advance according to the type of the input image data from the first voltage to generate the positive-polarity reference voltage, and an adder section for adding the change voltage to the second voltage to generate the negative-polarity reference voltage. The maximum applied voltage being the highest voltage required to be applied to the electro-optical material to obtain a range of transmittance used for displaying images for each type of the input image data. According to the present invention, when the electro-optical panel operates in a normally white mode, the first voltage at the positive side corresponding to a black level and the second voltage at the negative side are first generated with AC driving being taken into consideration, and then, the change voltage is subtracted and added to obtain the positive-polarity reference voltage and the negative-polarity reference voltage.

The control signal may indicate whether the input image data is based on computer graphics or based on a video signal. When the input image data is based on computer graphics, the input-image data values have high occurrence frequencies at high luminance. When the input image data is based on a video signal, the input-image data values have high occurrence frequencies at intermediate gradations.

It is also preferred that the input image data be sent from the outside together with a vertical synchronization signal indicating a vertical blanking period of the input image data, and the control-signal generating device detects the period of the vertical synchronization signal and generate the control signal according to the result of detection. Since computer graphics usually have a higher field frequency than video signals, the type of input image data can be determined according to the period of the vertical synchronization signal.

An image processing circuit according to the present invention can include a mean value generating device that calculates the mean gray scale value of an image according to input image data and for generating a mean value signal indicating the mean gray scale value, a data conversion device that converts the input image data to converted image data according to the mean value signal under a conversion rule based on the mean gray scale value, a D/A converter that converts the converted image data from a digital signal to an analog signal to generate an image signal, and a processing device that generates an output image signal to be sent to an electro-optical panel, according to the image signal.

Captured video has a bright portion and a dark portion in one screen. The gray scale of pixels constituting one screen are not distributed from the maximum luminance (saturated white) to the minimum luminance (saturated black) but are distributed in a certain range having its center at the mean gray scale value of one screen. According to the present invention, the converted image data is generated according to the mean gray scale value of an image, and D/A conversion is applied to the converted image data to generate the image signal. Therefore, a range of applied voltages to which data values are assigned can be changed according to the mean gray scale value of the image. Consequently, high-definition images can be displayed.

It is preferred that the mean value generating device calculates the mean gray scale value of an image according to input image data in one screen.

It is also preferred that the processing device includes an image-signal inversion section for inverting the signal polarity of the image signal at an inversion period determined in advance, with a certain potential being used as a reference while amplifying the image signal to generate an inverted image signal, a reference-signal generating section for generating a first reference voltage and a second reference voltage which are set to voltage values corresponding to the mean gray scale value, according to the mean value signal, and for alternately selecting one of the first reference voltage and the second reference voltage at the inversion period to generate a reference signal, and an output-image-signal generating section for synthesizing the inverted image signal with the reference signal to generate the output image signal.

According to the present invention, since the first reference voltage and the second reference voltage can be generated according to the mean gray scale value of an image, the output image signal can be generated according to the occurrence frequencies of data values, which are different depending on the mean gray scale value. In addition, when the reference voltage is applied to one electrode and the output image signal is applied to the other electrode, the electrodes sandwiching the electro-optical material, the polarity of an applied voltage applied to the electro-optical material can be inverted, and the electro-optical material can be AC-driven.

It is preferred that the reference-signal generating section include a minimum-applied-voltage generating section for generating the minimum voltage to be applied to the electro-optical material of the electro-optical panel according to the mean value signal under a conversion rule based on the mean gray scale value, a reference-voltage generating section for generating the first reference voltage by adding the minimum applied voltage to a reference potential determined in advance, and for generating the second reference voltage by subtracting the minimum applied voltage from the reference potential, and a selection section for alternately selecting one of the first reference voltage and the second reference voltage at the inversion period to generate the reference signal.

An image processing method according to the present invention is for generating an output image signal to be sent to one type of electro-optical panel selected from among a plurality of types of electro-optical panels determined in advance and having electro-optical materials in which their transmittances are changed according to an applied voltage. The method can include the steps of converting image input data from a digital signal to an analog signal to generate an image signal, and adjusting a range where the signal level of the image signal is changed, according to the type of the electro-optical panel, inverting the signal polarity of the image signal with a certain potential being used as a reference at an inversion period determined in advance while amplifying the image signal to generate an inverted image signal, alternately selecting one of a positive-polarity reference voltage higher than a reference potential determined in advance according to the type of the electro-optical panel, by a minimum applied voltage, and a negative-polarity reference voltage lower than the reference potential by the minimum applied voltage, at the inversion period to generate a reference signal, and synthesizing the inverted image signal and the reference signal to generate the output image signal, wherein the minimum applied voltage is specified for each electro-optical panel, and is the lowest voltage required to be applied to the electro-optical material to obtain a range of the transmittance to be used for displaying images.

According to the present invention, since a range in which the signal level of an image signal is changed can be adjusted according to the type of an electro-optical panel used, and the positive-polarity level and the negative-polarity level of the reference signal can be determined according to the type of the electro-optical panel, the output image signal can be generated according to the V-T characteristic of the electro-optical panel that is being used in combination. In addition, when the reference potential is sent to one electrode and the output image signal is sent to the other electrode, the electrodes sandwiching the electro-optical material, the polarity of an applied voltage applied to the electro-optical material can be inverted.

An image processing method according to the present invention is for generating an output image signal to be sent to an electro-optical panel having an electro-optical material in which its transmittance is changed according to an applied voltage. The method can include the steps of converting input image data to converted image data according to a conversion rule based on the type of the input image data, converting the converted image data from a digital signal to an analog signal to generate an image signal, inverting the signal polarity of the image signal with a certain potential being used as a reference at an inversion period determined in advance while amplifying the image signal to generate an inverted image signal; alternately selecting one of a positive-polarity reference voltage higher than a reference potential determined in advance according to the type of the input image data, by a minimum applied voltage, and a negative-polarity reference voltage lower than the reference potential by the minimum applied voltage, at the inversion period to generate a reference signal, and synthesizing the inverted image signal and the reference signal to generate the output image signal, wherein the minimum applied voltage is specified for each type of the input image data, and is the lowest voltage required to be applied to the electro-optical material to obtain a range of the transmittance to be used for displaying images.

According to the present invention, since a range in which the signal level of an image signal is changed can be adjusted according to the type of input image data, and the positive-polarity level and the negative-polarity level of the reference signal can be determined according to the type of the input image data, the output image signal can be generated such that a range of a V-T characteristic used can be changed according to the type of the input image data. Therefore, high-definition images can be displayed. In addition, when the reference potential is sent to one electrode and the output image signal is sent to the other electrode, the electrodes sandwiching the electro-optical material, the polarity of an applied voltage applied to the electro-optical material can be inverted.

An image processing method according to the present invention is for generating an output image signal to be sent to an electro-optical panel having an electro-optical material in which its transmittance is changed according to an applied voltage. The processing method can include the steps of calculating the mean gray scale value of an image according to input image data, converting the input image data to an converted image data according to a conversion rule based on the mean gray scale value, converting the converted image data from a digital signal to an analog signal to generate an image signal, inverting the signal polarity of the image signal with a certain potential being used as a reference at an inversion period determined in advance while amplifying the image signal to generate an inverted image signal, alternately selecting one of a positive-polarity reference voltage higher than a reference potential determined in advance, by a minimum applied voltage determined in advance according to the mean gray scale value, and a negative-polarity reference voltage lower than the reference potential by the minimum applied voltage, at the inversion period to generate a reference signal, and synthesizing the inverted image signal and the reference signal to generate the output image signal, wherein the minimum applied voltage is specified for each mean gray scale value, and is the lowest voltage required to be applied to the electro-optical material to obtain a range of the transmittance to be used for displaying images.

According to the present invention, since a range in which the signal level of an image signal is changed can be adjusted according to the mean gray scale value of an image, and the positive-polarity level and the negative-polarity level of the reference signal can be determined according to the mean gray scale value of the image, the output image signal can be generated such that a range of a V-T characteristic used can be changed according to the mean gray scale value of the image. Therefore, high-definition images can be displayed. In addition, when the reference potential is sent to one electrode and the output image signal is sent to the other electrode, the electrodes sandwiching the electro-optical material, the polarity of an applied voltage applied to the electro-optical material can be inverted.

An electro-optical apparatus according to the present invention includes the above-described image processing circuit; and an electro-optical panel having an electro-optical material in which its transmittance is changed according to an applied voltage and receiving the output image signal.

It is preferred that the electro-optical panel include a device substrate including a plurality of data lines, a plurality of scanning lines, switching devices disposed at the intersections of the plurality of data lines and the plurality of scanning lines, and pixel electrodes connected to the switching devices, an opposing substrate having an opposing electrode, and an electro-optical material sandwiched by the device substrate and the opposing substrate, the reference potential be the potential of the opposing electrode, and the output image signal be sequentially sent to the plurality of data lines.

An electronic apparatus according to the present invention includes the above-described electro-optical device. Such an electronic apparatus can be, for example, a video projector, a notebook personal computer, a portable telephone and the like.

BRIEF DESCRIPTION OF THE DRAWINGS

The present invention will now be described with reference to the accompanying drawings, wherein like numbers reference like elements, and wherein:

FIG. 2(*b*) is a view showing the second V-T characteristic of a liquid-crystal display panel 100B used for the liquid-crystal display device;

FIG. 7(*b*) is a view showing the input and output characteristic of the image-signal processing circuit 300A, employed when the liquid-crystal display panel 100B is used;

FIG. 9(*b*) is a view showing the probability density distribution of the data values of video data Db2;

FIG. 11(*b*) is a view showing the input and output characteristic of a second conversion table 3062;

FIG. 15(*b*) is a view showing the input and output characteristic of the image-signal processing circuit 300B, used when the input image data Db is video data Db2;

FIG. 28(*b*) is a view showing another example V-T characteristic.

DETAILED DESCRIPTION OF PREFERRED EMBODIMENTS

Figure 1:
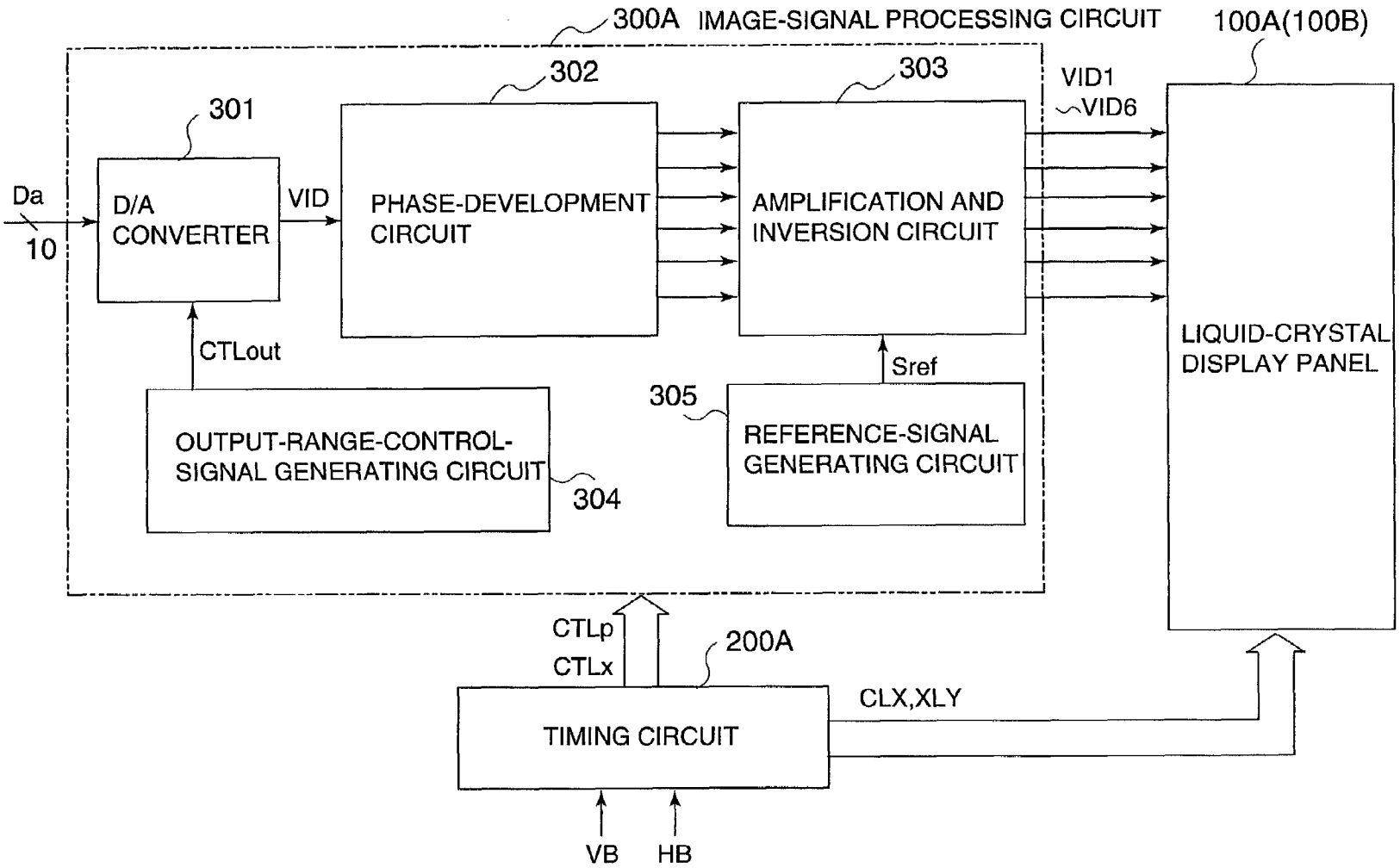
FIG. 1 is an exemplary block diagram showing the entire structure of a liquid-crystal display device according to a first embodiment of the present invention.

An active-matrix liquid-crystal display device according to a first embodiment will be described first as an example of an electro-optical device. FIG. 1 is an exemplary block diagram showing the entire structure of this liquid-crystal display device. The liquid-crystal display device according to the present invention is provided with a liquid-crystal display panel 100A, a control circuit 200A, and an image-signal processing circuit 300A. The liquid-crystal display device can be used with other liquid-crystal display panels instead of the liquid-crystal display panel 100A. It should be understood that there are no limitations on the number of types of panels which can be used. In the present embodiment, it is assumed that a liquid-crystal display panel 100B having a V-T characteristic different from that of the liquid-crystal display panel 100A can be used, in addition to the liquid-crystal display panel 100A. In the following description, the V-T characteristic of the liquid-crystal display panel 100A is called a first V-T characteristic, and the V-T characteristic of the liquid-crystal display panel 100B is called a second V-T characteristic.

Figure 2:
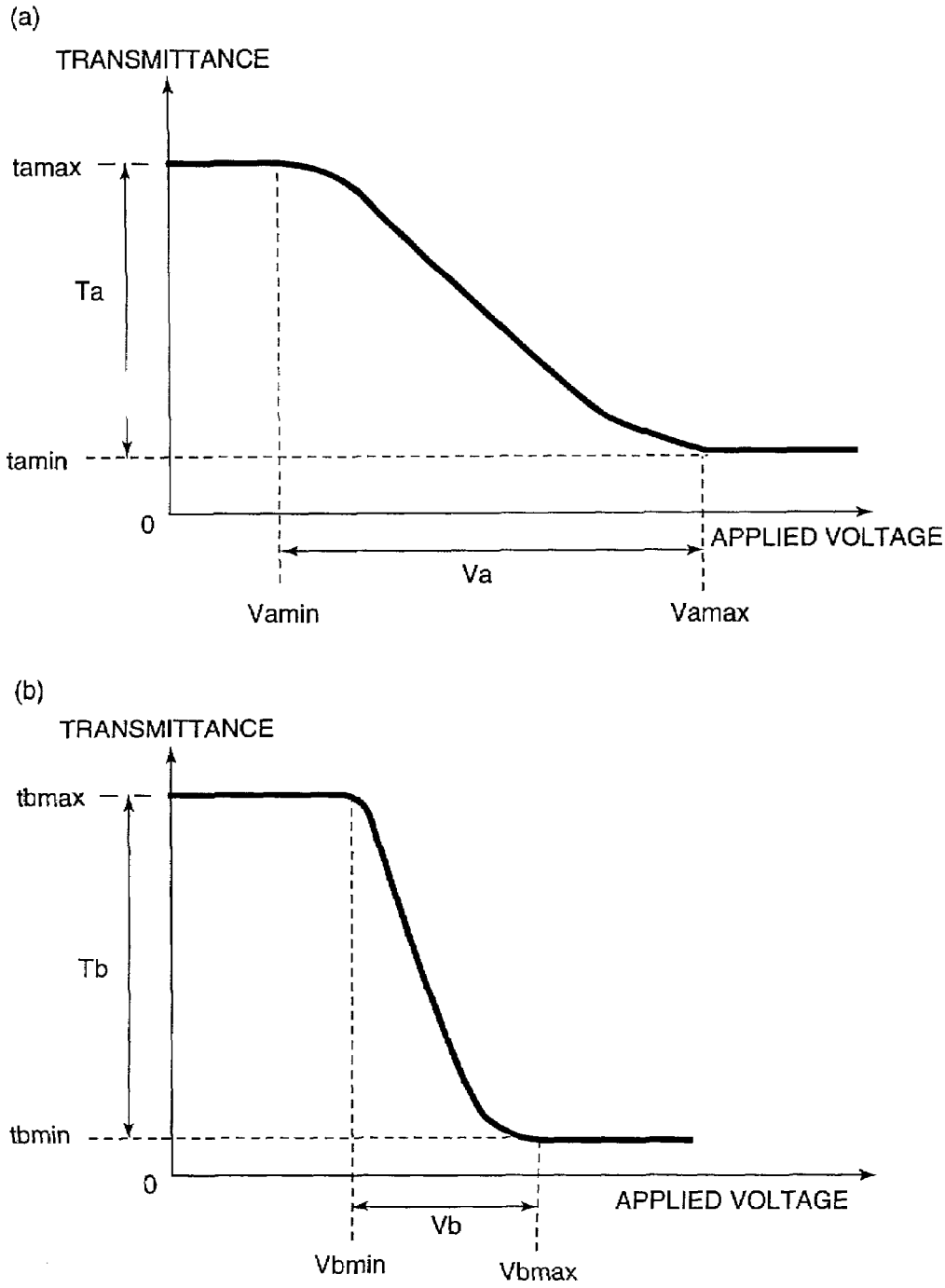
FIG. 2(*a*) is a view showing the first V-T characteristic of a liquid-crystal display panel 100A used for the liquid-crystal display device.

FIG. 2(*a*) shows the first V-T characteristic, and FIG. 2(*b*) shows the second V-T characteristic. A range of transmittance used for displaying gray scale images is that indicated by Ta or that indicated by Tb, and the corresponding range (voltage change) of an applied voltage is that indicated by Va or that indicated by Vb. To obtain high contrast, the transmittance ranges Ta and Tb are set to ranges where the transmittance is changed steeply against an applied voltage. As shown in FIG. 2(*a*) and FIG. 2(*b*), the liquid-crystal display panels 100A and 100B operate in a normally white mode, in which transmittance is high when an applied voltage is low. It is needless to say that a panel operating in a normally black mode, in which transmittance is low when an applied voltage is low, can be used.

Figure 3:
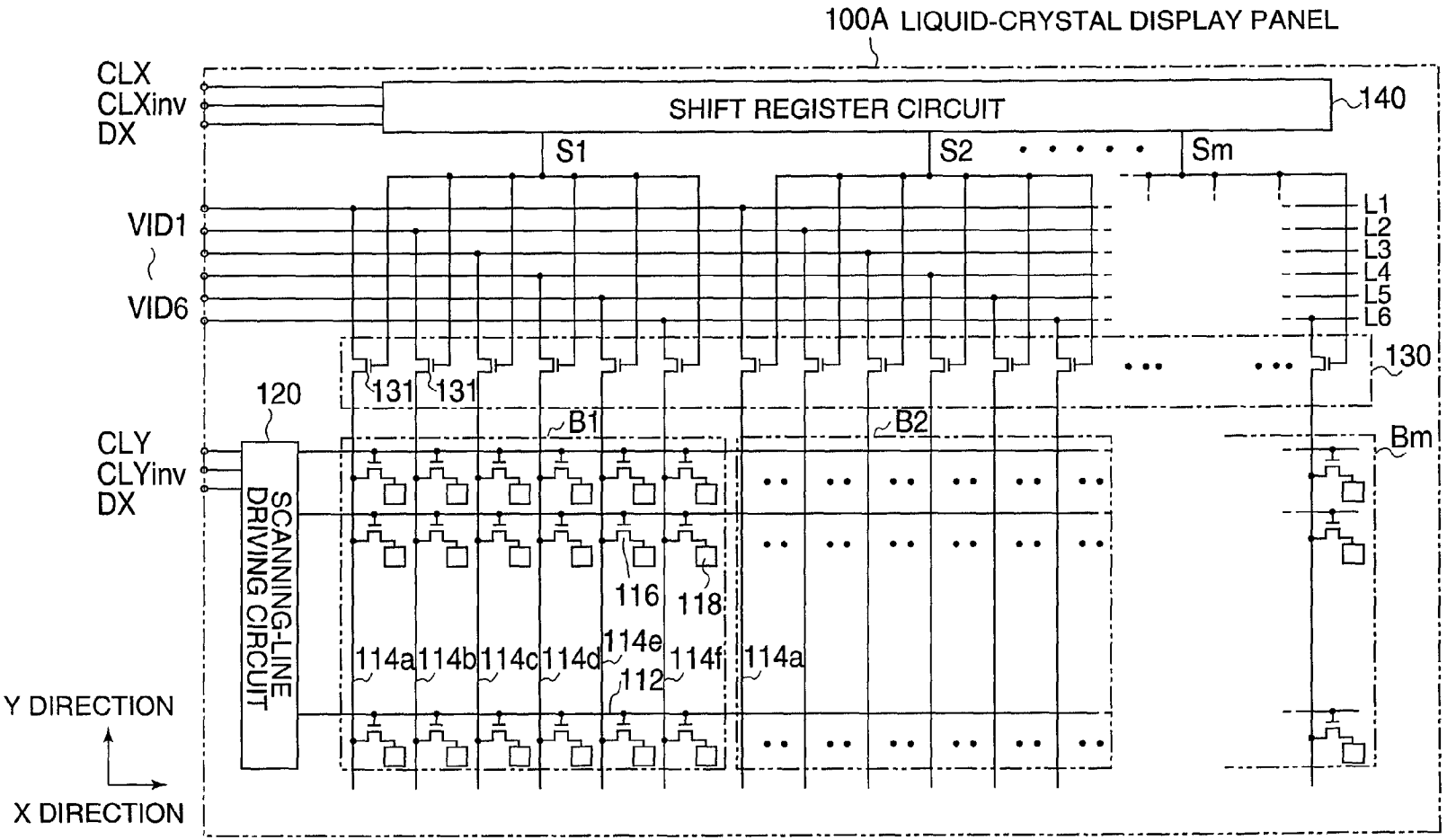
FIG. 3 is an exemplary block diagram showing the electric structure of a liquid-crystal display panel used for the liquid-crystal display device.

The liquid-crystal display panel 100A will be described next. FIG. 3 is a block diagram showing the structure of the liquid-crystal display panel 100A. Since the liquid-crystal display panel 100B is structured in the same way as the liquid-crystal display panel 100A except for the V-T characteristic, a description thereof is omitted. The liquid-crystal display panel 100A has a structure in which a device substrate and an opposing substrate are disposed opposite each other with a gap therebetween, and liquid crystal is sealed in the gap. The device substrate and the opposing substrate are formed of a quartz substrate, hard glass, and others.

In the device substrate, a plurality of scanning lines 112 are formed in parallel along an X direction in FIG. 3, and a plurality of data lines 114 are arranged in parallel along a Y direction which is perpendicular to the X direction. Six data lines 114 are grouped into a block, and the plurality of data lines 114 are called blocks B1 to Bm. For simplicity in the following description, data lines are collectively symbolized as 114 if they are generally referred to, and they are symbolized as 114*a* to 114*f* if each of them is particularly referred to.

At each of the intersections of the scanning lines 112 and the data lines 114, a TFT 116 is formed as a switching device. The gate electrode of the TFT 116 is connected to a scanning line 112, the source electrode thereof is connected to a data line 114, and the drain thereof is connected to an pixel electrode 118. Each pixel includes a pixel electrode 118, a common electrode formed on the opposing substrate, and liquid crystal sandwiched by both electrodes. Pixels are arranged in a matrix at the intersections of the scanning lines 112 and the data lines 114. A holding capacitor (not shown) is further formed and connected to each pixel electrode 118.

A scanning-line driving circuit 120 is formed on the device substrate, and sequentially outputs scanning pulse signals to the scanning lines 112 according to a clock signal CLY, its inverted clock signal CLYinv, a transmission start pulse DY, and others sent from the timing circuit 200A. More specifically, the scanning-line driving circuit 120 sequentially shifts the transmission start pulse DY received at the start of a vertical scanning period, according to the clock signal CLY and its inverted clock signal CLYinv, and outputs as scanning-line signals to sequentially select the scanning lines 112.

A sampling circuit 130 can include a sampling switch 131 for each data line 114 at one end of the data line 114. The switches 131 are formed of TFTs made on the same device substrate. Output phase-development image signals VID1 to VID6 are input to the source electrodes of switches 131 through image-signal supply lines L1 to L6. The gate electrodes of six switches 131 connected to data lines 114*a* to 114*f* in the block B1 are connected to a signal line through which a sampling signal S1 is sent, the gate electrodes of six switches 131 connected to data lines 114*a* to 114*f* in the block B2 are connected to a signal line through which a sampling signal S2 is sent, and in the same way, the gate electrodes of six switches 131 connected to data lines 114*a* to 114*f* in the block Bm are connected to a signal line through which a sampling signal Sm is sent. The sampling signals S1 to Sm sample the output image signals VID1 to VID6 in units of blocks within effective horizontal display periods.

A shift register circuit 140 can be formed on the same device substrate, and sequentially outputs the sampling signals S1 to Sm according to the clock signal CLX, its inverted clock signal CLXinv, the transmission start pulse DX, and others sent from the timing circuit 200A. More specifically, the shift register circuit 140 sequentially shifts the transmission start pulse DY received at the start of a horizontal scanning period, according to the clock signal CLY and its inverted clock signal CLYinv, and outputs as the sampling signals S1 to Sm.

In such a structure, when the sampling signal S1 is output, the output phase-development signals VID1 to VID6 are sampled at the six data lines 114*a* to 114*f* in the block B1, and the output phase-development image signals VID1 to VID6 are written to six pixels connected to the currently selected scanning line by the corresponding TFTs 116.

Then, when the sampling signal S2 is output, the output phase-development signals VID1 to VID6 are sampled at the six data lines 114*a* to 114*f* in the block B2, and the output phase-development image signals VID1 to VID6 are written to six pixels connected to the currently selected scanning line by the corresponding TFTs 116.

In the same way, when the sampling signals S3, S4, . . . , Sm are sequentially output, the output phase-development signals VID1 to VID6 are sampled at the six data lines 114*a* to 114*f* in the blocks B3, B4, . . . , Bm, and the output phase-development image signals VID1 to VID6 are written to six pixels connected to the currently selected scanning line. Then, the next scanning line is selected, the same writing operation is repeatedly executed in the blocks B1 to Bm.

In this driving method, the number of stages of the shift register circuit 140, which drives and controls the switches 131 in the sampling circuit 130, can be reduced to one sixth that in a method for driving each data line in a dot-sequential manner. In addition, the frequency of the clock signal CLX and its inverted clock signal CLXinv to be sent to the shift register circuit 140 can also be one sixth that in the dot-sequential driving method, the number of stages is reduced as well as power consumption is reduced.

An opposing electrode is formed on the opposing substrate, and the timing circuit 200A sends an opposing-electrode voltage thereto. Since the liquid crystal is sandwiched by the pixel electrodes 118 and the opposite electrode, the potential difference between the pixel electrodes 118 and the opposing electrode is a voltage applied to the liquid crystal.

The timing circuit 200A generates various timing signals according to a dot-clock signal DCLK, a vertical synchronizing signal VB, and a horizontal blanking signal HB, and in addition, generates a panel-type control signal CTLp which indicates the types of the liquid-crystal display panels 100A and 100B. The dot-clock signal DCLK is a signal synchronized with a sampling period of input image data Da. The vertical synchronizing signal VB has an L level in a vertical blanking period whereas it has an H level in the other periods. The horizontal blanking signal has the L level in a horizontal blanking period whereas it has the H level in the other periods.

When the panel-type control signal CTLp has the H level, it means that the liquid-crystal display panel 100A is used. When the panel-type control signal CTLp has the L level, it means that the liquid-crystal display panel 100B is used. In the present embodiment, the timing circuit 200A is connected to a DIP switch not shown. The user can switch the operator thereof to input a panel type. The timing circuit 200A detects the state of the DIP switch to generate the panel-type control signal CTLp.

In addition, the timing circuit 200A selects one of a first opposing-electrode voltage Vc1 and a second opposing-electrode voltage Vc2 according to the panel-type control signal CTLp, and sends it to the liquid-crystal display panel 100A or 100B. More specifically, the timing circuit 200A selects the first opposing-electrode voltage Vc1 when the panel-type control signal VTLp has the H level, and selects the second opposing-electrode voltage Vc2 when the panel-type control signal CTLp has the L level.

The image-signal processing circuit 300A includes a D/A converter 301, a phase development circuit 302, an amplification and inversion circuit 303, an output-range-control-signal generating circuit 304, and a reference-signal generating circuit 305. The input image data Da is input thereinto from an external apparatus not shown. The input image data Da is a 10-bit parallel data string having a sampling period equal to the period of the dot-clock signal DCLK.

Figure 4:
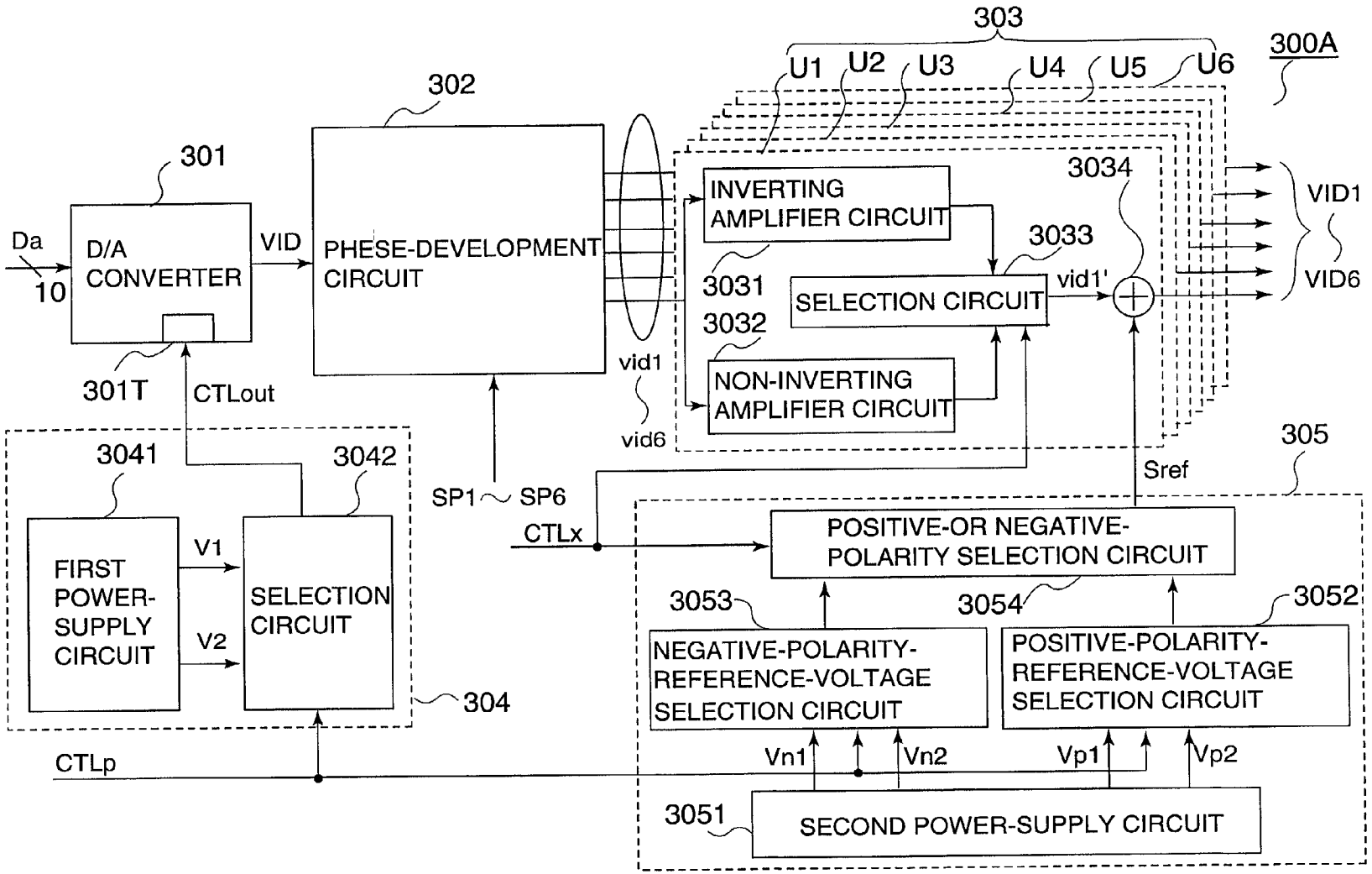
FIG. 4 is an exemplary block diagram showing the structure of an image-signal processing circuit 300A used for the liquid-crystal display device.

FIG. 4 is an exemplary block diagram showing a detailed structure of the image-signal processing circuit 300A. The D/A converter 301 has a control input terminal 301T, converts the 10-bit input image data Da from a digital signal to an analog signal, and outputs as an image signal VID. The D/A converter 301 also controls its output range according to a voltage applied to the control input terminal 301T. The output range refers to a range from the signal level of the image signal VID corresponding to the minimum value, "0," of the input image data Da to the signal level of the image signal VID corresponding to the maximum value, "1023," of the input image data Da. In other words, the output range is a range where the signal level of the image signal VID is changed, and is determined by the minimum value and the maximum value of the image signal VID. In the present embodiment, the minimum value of the image signal VID is fixed to the ground potential, and the maximum value of the image signal VID and the amount of a change per one bit are adjusted according to a voltage applied to the control input terminal 301T.

The output-range-control-signal generating circuit 304 has a first power-supply circuit 3041 and a selection circuit 3042. The first power-supply circuit 3041 includes constant-voltage sources for generating a first output-range setting voltage V1 and a second output-range setting voltage V2. The first output-range setting voltage V1 is set such that, when it is applied to the control input terminal 301T, the range of a voltage applied finally to the liquid crystal is set to the range Va shown in FIG. 2(*a*). On the other hand, the second output-range setting voltage V2 is set such that, when it is applied to the control input terminal 301T, the range of a voltage applied finally to the liquid crystal is set to the range Vb shown in FIG. 2(*b*).

The selection circuit 3042 selects the first output-range setting voltage V1 or the second output-range setting voltage V2 according to the panel-type control signal CTLp to generate an output-range control signal CTLout and sends it to the control input terminal 301T.

As described later, the gain of the phase-development circuit 302 is 1, and that of the amplification and inversion circuit 303 is A or −A. The input and output characteristic of the D/A converter 301 will be examined. The range of a voltage which should be finally applied to the liquid crystal is the range Va shown in FIG. 2(*a*) when the liquid-crystal display panel 100A is used, and is the range Vb shown in FIG. 2(*b*) when the liquid-crystal display panel 100B is used. Therefore, it is necessary that the signal level of the image signal VID be changed by Va/A when the liquid-crystal display panel 100A is used, and the signal level of the image signal VID be changed by Vb/A when the liquid-crystal display panel 100B is used.

Figure 5:
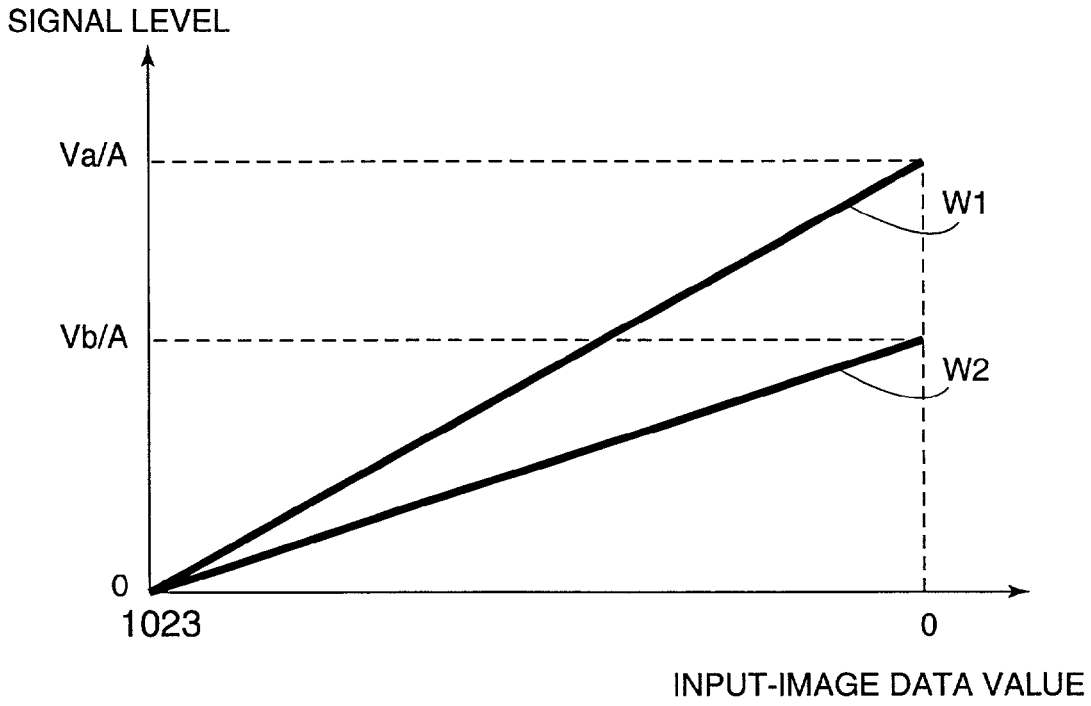
FIG. 5 is a view showing the input and output characteristic of a D/A converter 301 in the liquid-crystal display device.

FIG. 5 is a view showing the input and output characteristic of the D/A converter 301. In the figure, a characteristic WI is the input and output characteristic of the D/A converter 301 obtained when the first output-range setting voltage V1 is applied to the control input terminal 301T, and a characteristic W2 is the input and output characteristic of the D/A converter 301 obtained when the second output-range setting voltage V2 is applied to the control input terminal 301T. It is clear from the figure that, when the first output-range setting voltage V1 is applied to the control input terminal 301T, the output range of the D/A converter 301 is from 0 to Va/A, and when the second output-range setting voltage V2 is applied to the control input terminal 301T, the output range of the D/A converter 301 is from 0 to Vb/A. In other words, the output range of the D/A converter 301 is the applied-voltage range Va or Vb used for the liquid-crystal display panel 100A or 100B divided by the gain A. Therefore, the output range of the D/A converter 301 can be adjusted correspondingly to the applied-voltage range determined by the type of the liquid-crystal display panel used.

The phase-development circuit 302 applies serial-to-parallel conversion to the image signal VID to generate phase-development image signals VID1 to VID6 developed in six phases. More specifically, the phase-development circuit 302 samples and holds the image signal VID according to six-phase sample-and-hold pulses SP1 to SP6 which are active every six periods of the dot-clock signal DCLK to extend the time axis of the image signal VID six times, and divides the image signal into six phases to generate the phase-development image signals VID1 to VID6. The gain of the phase-development circuit 302 is 1.

The amplification and inversion circuit 303 has six processing units U1 to U6 for the phase-development image signals VID1 to VID6. Since each of the processing units U1 to U6 has the same structure, only the processing unit U1 corresponding to the phase-development image signal VID1 will be described below and descriptions of the other processing units U2 to U6 are omitted.

The processing unit U1 has a non-inverting amplifier circuit 3031, an inverting amplifier circuit 3032, and a selection circuit 3033. The non-inverting amplifier circuit 3031 amplifies the phase-development image signal VID1 in a non-inverting manner, and the inverting amplifier circuit 3032 inverts and amplifies the phase-development image signal VID1. The gain of the non-inverting amplifier circuit 3031 is A, and the gain of the inverting amplifier circuit 3032 is −A.

The selection circuit 3033 selects either a signal output from the non-inverting amplifier circuit 3031 or a signal output from the inverting amplifier circuit 3032 according to a polarity control signal CTLx, and outputs as an inverting image signal vid'. The selection circuit 3033 selects a signal output from the non-inverting amplifier circuit 3031 when the polarity control signal CTLx has the H level, and the selection circuit 3033 selects a signal output from the inverting amplifier circuit 3032 when the polarity control signal CTLx has the L level. In the present embodiment, polarity is inverted in units of scanning lines. Therefore, the polarity control signal CTLx has a period equal to two horizontal scanning periods 2H. The signal level of the inverted image signal vid' is inverted in units of horizontal scanning periods.

It can be said from the above that the non-inverting amplifier circuit 3031, the inverting amplifier circuit 3032, and the selection circuit 3033 have a function for amplifying an image signal as well as for inverting the level of the signal at an inversion period determined in advance.

The processing unit U1 also has an adder circuit 3034. The adder circuit 3034 adds the inverted image signal vid' to a reference signal Sref to generate an output phase-development image signal.

The reference-signal generating circuit 305 generates the reference signal Sref. The reference-signal generating circuit 305 includes a second power-supply circuit 3051, a positive-polarity-reference-voltage selection circuit 3052 and a negative-polarity-reference-voltage selection circuit 3053, and a positive- or negative-polarity selection circuit 3054. The second power-supply circuit 3051 has a plurality of constant-voltage sources. The constant-voltage sources generate a first positive-polarity reference voltage Vp1, a second positive-polarity reference voltage Vp2, a first negative-polarity reference voltage Vn1, and a second negative-polarity reference voltage Vn2.

The first minimum applied voltage corresponding to the maximum transmittance tamax is called Vamin, and the first maximum applied voltage corresponding to the minimum transmittance tamin is called Vamax in the first V-T characteristic shown in FIG. 2(*a*), and the second minimum applied voltage corresponding to the maximum transmittance tbmax is called Vbmin, and the second maximum applied voltage corresponding to the minimum transmittance tbmin is called Vbmax in the second V-T characteristic shown in FIG. 2(*b*).

In this case, the first positive-polarity reference voltage Vp1 is obtained by adding the first minimum applied voltage Vamin to the first opposing-electrode voltage Vc1, and the first negative-polarity reference voltage Vn1 is obtained by subtracting the first minimum applied voltage Vamin from the first opposing-electrode voltage Vc1. The first opposing-electrode voltage Vc1 is the voltage applied to the opposite electrode formed on the opposite substrate of the liquid-crystal display panel 100A. The second positive-polarity reference voltage Vp2 is obtained by adding the second minimum applied voltage Vbmin to the second opposing-electrode voltage Vc2, and the second negative-polarity reference voltage Vn2 is obtained by subtracting the second minimum applied voltage Vbmin from the second opposing-electrode voltage Vc2. The second opposing-electrode voltage Vc2 is the voltage applied to the opposing electrode formed on the opposing substrate of the liquid-crystal display panel 100B, described later.

The positive-polarity-reference-voltage selection circuit 3052 selects the first positive-polarity reference voltage Vp1 when the panel-type control signal CTLp has the H level, and selects the second positive-polarity reference voltage Vp2 when the panel-type control signal CTLp has the L level to generate a positive-polarity reference voltage Vp. The negative-polarity-reference-voltage selection circuit 3053 selects the first negative-polarity reference voltage Vn1 when the panel-type control signal CTLp has the H level, and selects the second negative-polarity reference voltage Vn2 when the panel-type control signal CTLp has the L level to generate a negative-polarity reference voltage Vn.

The positive- or negative-polarity selection circuit 3054 selects the positive-polarity reference voltage Vp when the polarity control signal CTLx has the H level, and selects the negative-polarity reference voltage Vn when the polarity control signal CTLx has the L level to generate the reference signal Sref.

Figure 6:
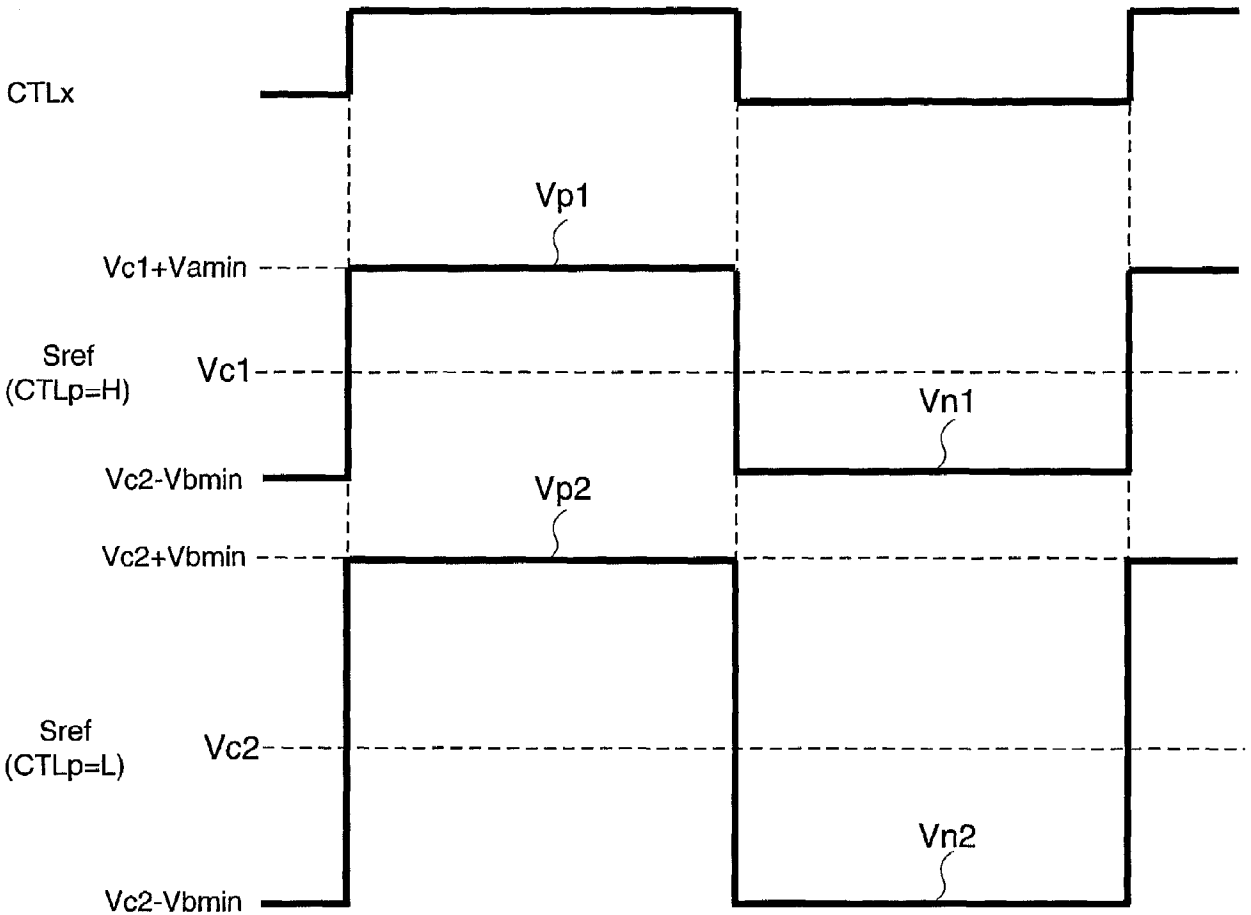
FIG. 6 is a timing chart showing the waveforms of a polarity control signal CTLx and a reference signal Sref in the liquid-crystal display device.

FIG. 6 is a timing chart showing the waveforms of the polarity control signal CTLx and the reference signal Sref. As shown in the figure, when the liquid-crystal display panel 100A is used (CTLp has the H level), the reference signal Sref is inverted against the first opposing-electrode voltage Vc1 being used as a center voltage, in synchronization with the polarity control signal CTLx. When the polarity control signal CTLx indicates the positive polarity, the reference signal Sref has the first positive-polarity reference voltage Vp1, which is higher than the first opposing-electrode voltage Vc1 by the first minimum applied voltage Vamin. When the polarity control signal CTLx indicates the negative polarity, the reference signal Sref has the first negative-polarity reference voltage Vn1, which is lower than the first opposing-electrode voltage Vc1 by the first minimum applied voltage Vamin.

When the liquid-crystal display panel 100B is used (CTLp has the L level), the reference signal Sref is inverted against the second opposing-electrode voltage Vc2 being used as a center voltage, in synchronization with the polarity control signal CTLx. When the polarity control signal CTLx indicates the positive polarity, the reference signal Sref has the second positive-polarity reference voltage Vp2, which is higher than the second opposite-electrode voltage Vc2 by the second minimum applied voltage Vbmin. When the polarity control signal CTLx indicates the negative polarity, the reference signal Sref has the second negative-polarity reference voltage Vn2, which is lower than the second opposing-electrode voltage Vc2 by the second minimum applied voltage Vbmin.

Figure 7:
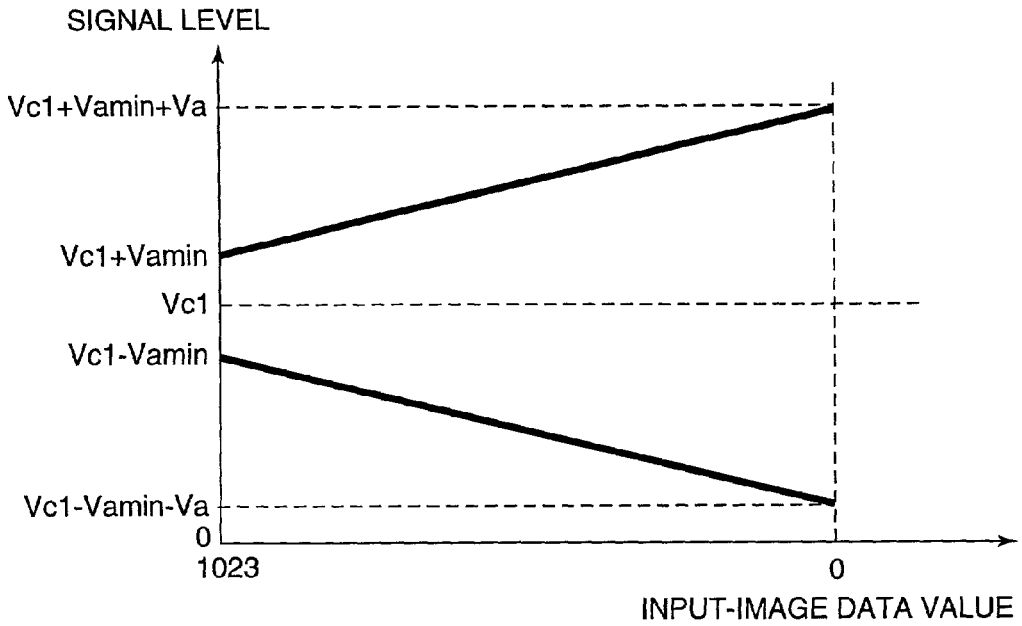
FIG. 7(*a*) is a view showing the input and output characteristic of the image-signal processing circuit 300A, employed when the liquid-crystal display panel 100A is used.
Figure 7:
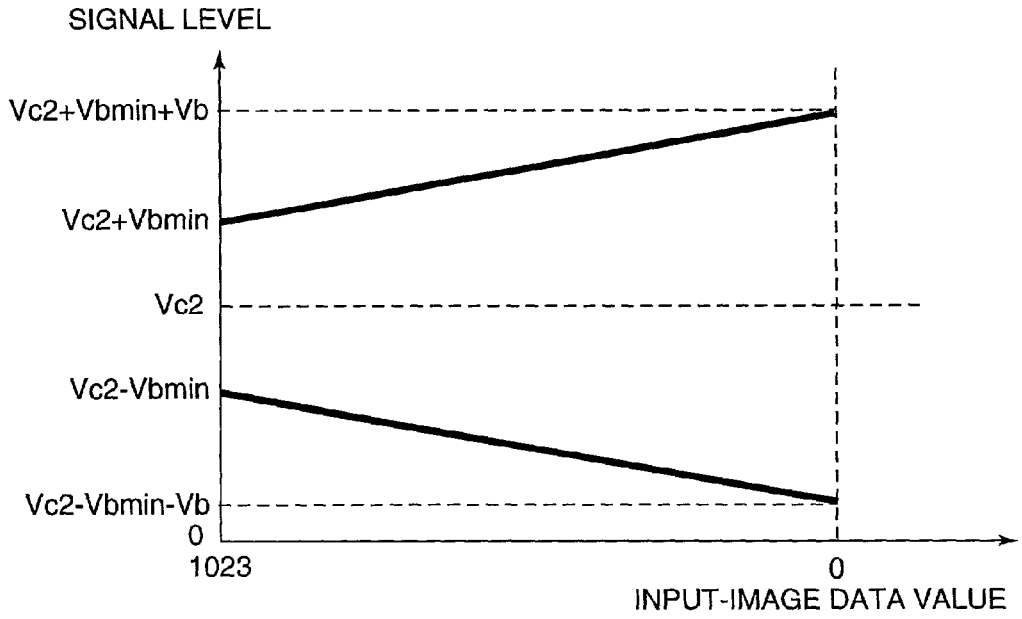

As described above, since the output phase-development image signal VID1 is obtained by adding the inverted image signal vid1' to the reference signal Sref, when the image-signal processing circuit 300A is used with the liquid-crystal display panel 100A, the entire image-signal processing circuit 300A has an input and output characteristic shown in FIG. 7(*a*). When the image-signal processing circuit 300A is used with the liquid-crystal display panel 100B, the entire image-signal processing circuit 300A has an input and output characteristic shown in FIG. 7(*b*). Therefore, the image-signal processing circuit 300A can be used with a plurality of liquid-crystal display panels, 100A and 100B, having different V-T characteristics.

The operation of the liquid-crystal display device will be described next. When the timing circuit 200A generates the panel-type control signal CTLp, the output-range-control-signal generating circuit 304 selects either the first output-range setting voltage V1 or the second output-range setting voltage V2 according to the panel-type control signal CTLp to generate the output-range control signal CTLout.

Since the input and output characteristic of the D/A converter 301 is determined by the output-range control signal CTLout sent to the control input terminal 301T, the characteristic W1 is set when the liquid-crystal display panel 100A is used, and the characteristic W2 is set when the liquid-crystal display panel 100B is used (see FIG. 5). Therefore, according to the present embodiment, the output range of the D/A converter 301 can be adjusted according to the V-T characteristic of the liquid-crystal display panel used. In other words, the output range of the D/A converter 301 can be adjusted according to the transmittance range of the liquid-crystal display panel used with the image-signal processing circuit 300A.

As shown in FIG. 5, the output range of the D/A converter 301 is from 0 to Va/A in the characteristic WI, and the output range is from 0 to Vb/A in the characteristic W2. The gain of the phase-development circuit 302 is 1, and the gain of the amplification and inversion circuit 303 is A or −A. Therefore, if polarity inversion is ignored, the signal levels of the output phase-development image signals VID1 to VID6 are changed by Va when the input and output characteristic of the D/A converter 301 is set to the characteristic W1, and the signal levels of the output phase-development image signals VID1 to VID6 are changed by Vb when the input and output characteristic of the D/A converter 301 is set to the characteristic W2. This means that data values (0 to 1023) of the input image data Da are assigned to the applied-voltage range Va or Vb according to the type of the V-T characteristic. Therefore, a contrast ratio can be made maximum when the image-signal processing circuit 300A is used with any of the liquid-crystal display panels 100A and 100B.

When the first V-T characteristic and the second V-T characteristic are compared, it is found as shown in FIG. 2 that Tb is greater than Ta in terms of the transmittance range, and Va is greater than Vb in terms of the applied-voltage range. In the present embodiment, since data values ranging from 0 to 1023 of the input image data Da are assigned to the applied-voltage range Va or Vb, a change of transmittance per bit is smaller in the liquid-crystal display panel 100B than in the liquid-crystal display panel 100A. Therefore, when the liquid-crystal display panel 100B is used, higher-definition images can be displayed.

When the phase-development circuit 302 applies phase development to the image signal VID to generate the phase-development image signals vid1 to vid6, the amplification and inversion circuit 303 amplifies the phase-development image signals vid1 to vid6 and inverts them at the inversion period determined in advance to obtain the inverted image signals vid1' to vid6', and adds them to the reference signal Sref to generate the output phase-development image signals VID1 to VID6. The reference signal Sref is generated by alternately selecting either the positive-polarity reference voltage Vp or the negative-polarity reference voltage Vn at the inversion period. The positive-polarity reference voltage Vp and the negative-polarity reference voltage Vn have their center voltages equal to the opposite-electrode voltage Vc1 or Vc2, and have an offset of the minimum applied voltage Vamin or Vbmin against the opposite-electrode voltage Vc1 or Vc2. Therefore, by adding the reference signal Sref, the minimum applied voltage Vamin or Vbmin can be always applied to the liquid crystal in synchronization with polarity inversion.

If, instead of the reference signal Sref, the opposite-electrode voltage Vc1 or Vc2 is added to the inverted image signals vid1' and vid6' to generate the output phase-development image signals VID1 to VID6, it is necessary to set the output range of the D/A converter 301 to that from 0 to (Va+Vamin)/A or from 0 to (Vb+Vbmin)/A. This means that data values of the input image data Da are assigned also to a range lower than the minimum applied voltage Vamin or Vbmin. Since the range of data values assigned to the applied-voltage range is reduced with such an assignment, a change of transmittance per bit is increased.

In the present embodiment, however, the minimum applied voltage Vamin or Vbmin determined according to the type of a liquid-crystal display panel used is added as an offset to the opposite-electrode voltage Vc1 or Vc2, as described above. Therefore, it is not necessary to assign the data values of the input image data Da to a range lower than the minimum applied voltage Vamin or Vbmin. All the data values can be assigned to the applied-voltage range Va or Vb used for displaying gray scale images. As a result, high-definition display is allowed.

A liquid-crystal display device according to a second embodiment will be described next. In the liquid-crystal display device according to the second embodiment, a transmittance range to which the data values of input image data are assigned is changed according to the type of input image data.

Figure 8:
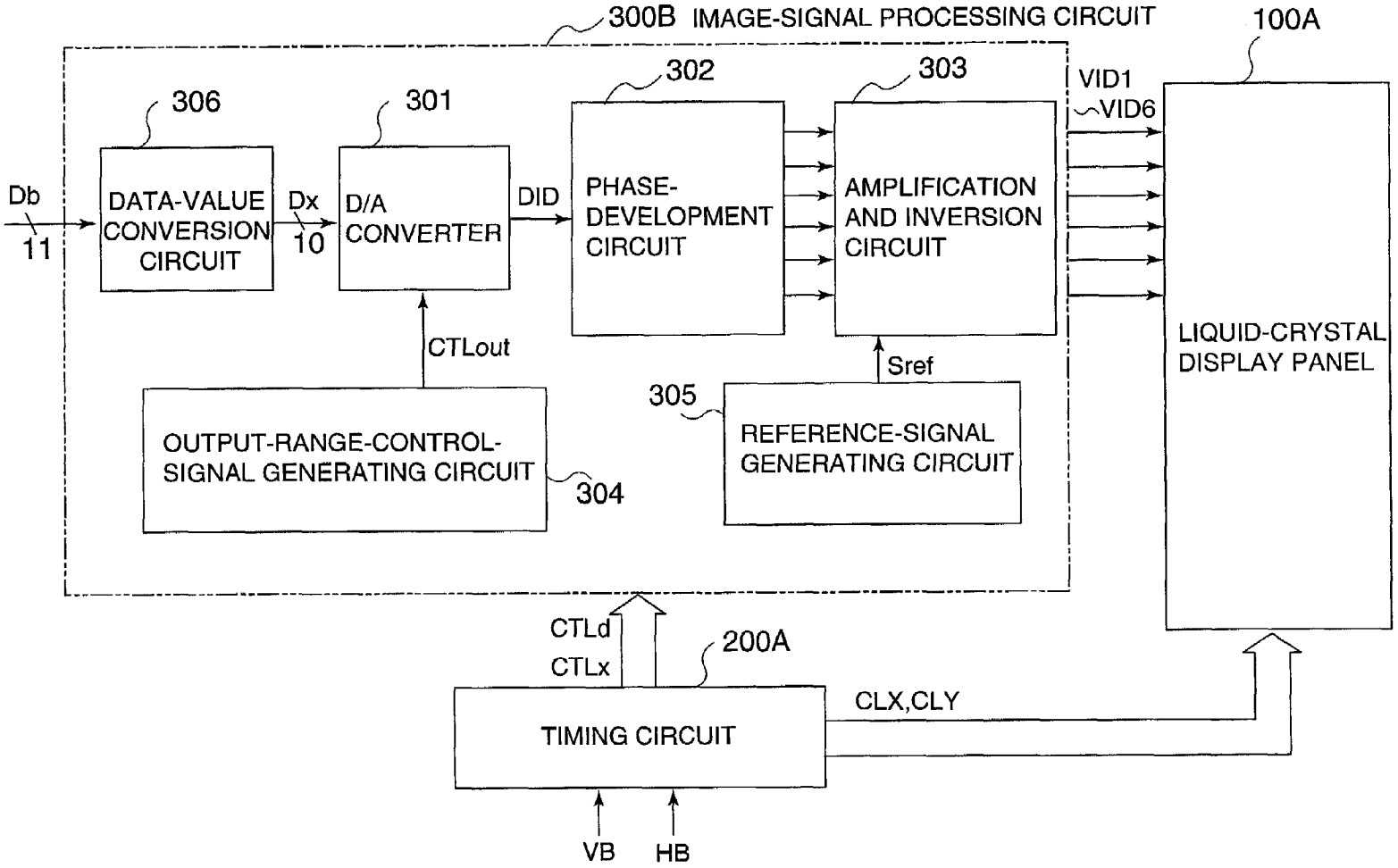
FIG. 8 is an exemplary block diagram showing the entire structure of a liquid-crystal display device according to a second embodiment of the present invention.

FIG. 8 is an exemplary block diagram showing the structure of the liquid-crystal display device according to the second embodiment. The liquid-crystal display device shown in the figure is almost the same as the liquid-crystal display device of the first embodiment shown in FIG. 1, except that an image-signal processing circuit 300B is used instead of the image-signal processing circuit 300A and the timing circuit 200A generates a data-type control signal CTLd indicating the type of data instead of the panel-type control signal CTLp indicating the type of a liquid-crystal display panel used.

Input image data Db sent to the liquid-crystal display device is of a 11-bit parallel type. There are various types of input image data Db. In the present embodiment, two types of input image data Db are assumed, one being input image data Db made by computer graphics, and the other being made from a video signal. To differentiate these two types, the former is referred to as graphics data Db1, and the latter is referred to as video data Db2.

The natures of the graphics data Db1 and the video data Db2 will be described next. Since images are vividly displayed in many cases in computer graphics, the saturation and lightness of displayed colors are high. Therefore, the data values of the graphics data Db1 generally incline toward a high luminance. In the present embodiment, it is assumed that the data values of the graphics data Db1 are distributed in a probability density shown in FIG. 9(*a*). On the other hand, since the image data Db2 is generated according to the video signal, the data values thereof incline toward intermediate gray shades in many cases. In the present embodiment, it is assumed that the data values of the video data Db2 are distributed in a probability density shown in FIG. 9(*b*). The probability densities shown in FIG. 9(*a*) and FIG. 9(*b*) are normalized by their maximum values.

The graphics data Db1 generated by a personal computer or the like has a field frequency of 120 Hz whereas the video data Db2 such as a moving picture has a field frequency of 60 Hz. The timing circuit 200A detects the frequency of the vertical synchronizing signal VB sent together with an input image data Db from the outside, and compares the frequency with a threshold frequency (such as 90 Hz) specified in advance to generate the data-type control signal CTLd. The timing circuit 200A sets the data-type control signal CTLd to the H level when input image data Db is graphics data Db1, and sets the data-type control signal CTLd to the L level when input image data Db is video data Db2.

Since the use of one type of a liquid-crystal display panel, the liquid-crystal display panel 100A, is a precondition in the present embodiment, a power-supply circuit not shown directly sends the first opposing-electrode voltage Vc1 to the liquid-crystal display panel 100A unlike the first embodiment, in which the timing circuit 200A selects either the first opposing-electrode voltage Vc1 or the second opposing-electrode voltage Vc2 to output to the panel.

Figure 10:
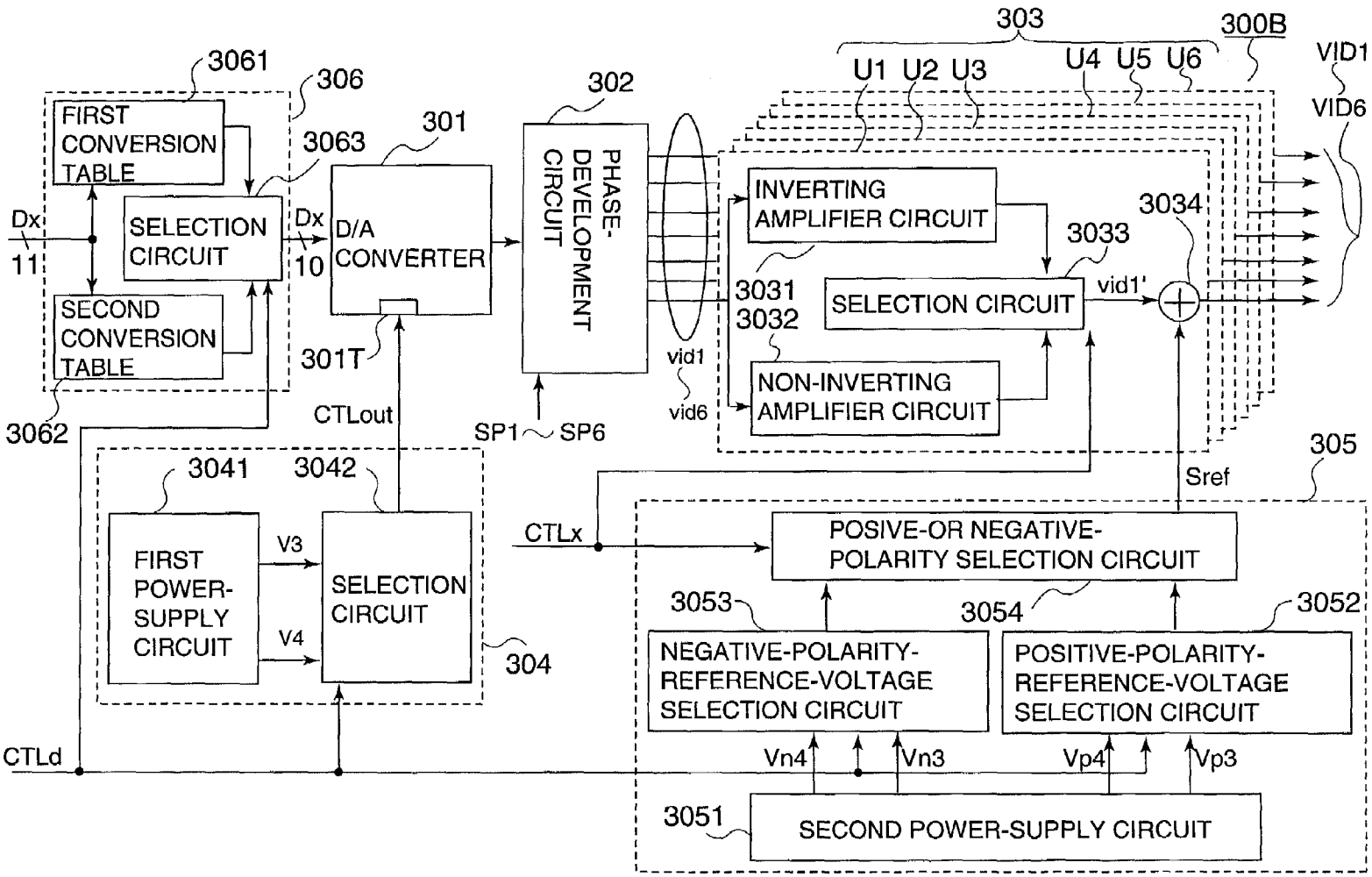
FIG. 10 is an exemplary block diagram showing the structure of an image-signal processing circuit used in the liquid-crystal display device.

FIG. 10 is an exemplary block diagram showing the structure of an image-signal processing circuit 300B used in the liquid-crystal display device according to the second embodiment. The image-signal processing circuit 300B is the same as the image-signal processing circuit 300A of the first embodiment shown in FIG. 4, except that a data-value conversion circuit 306 is provided, that the first power-supply circuit 3041 generates third and fourth output-range setting voltages V3 and V4, instead of the first and second output-range setting voltages V1 and V2, and that the second power-supply circuit 3051 generates third and fourth positive-polarity reference voltages Vp3 and Vp4, instead of the first and second positive-polarity reference voltages Vp1 and Vp2, and generates third and fourth negative-polarity reference voltages Vn3 and Vn4, instead of the first and second negative-polarity reference voltages Vn1 and Vn2. The above differences will be described below.

The data-value conversion circuit 306 converts 11-bit input image data Db to 10-bit converted image data Dx according to the type of data. The data-value conversion circuit 306 can include a first conversion table 3061, a second conversion table 3062, and a selection circuit 3063, as shown in FIG. 10.

The first and second conversion tables 3061 and 3062 are formed of ROMs having 11 input bits and 10 output bits. The 11-bit input image data Db is used as a reading address, and first conversion data Dx1 and second conversion data Dx2 both of which have 10 bits are read from corresponding storage areas. The selection circuit 3063 selects the first conversion data Dx1 when the data-type control signal CTLd has the H level, and selects the second conversion data Dx2 when the data-type control signal CTLd has the L level to generate converted image data Dx.

Figure 11:
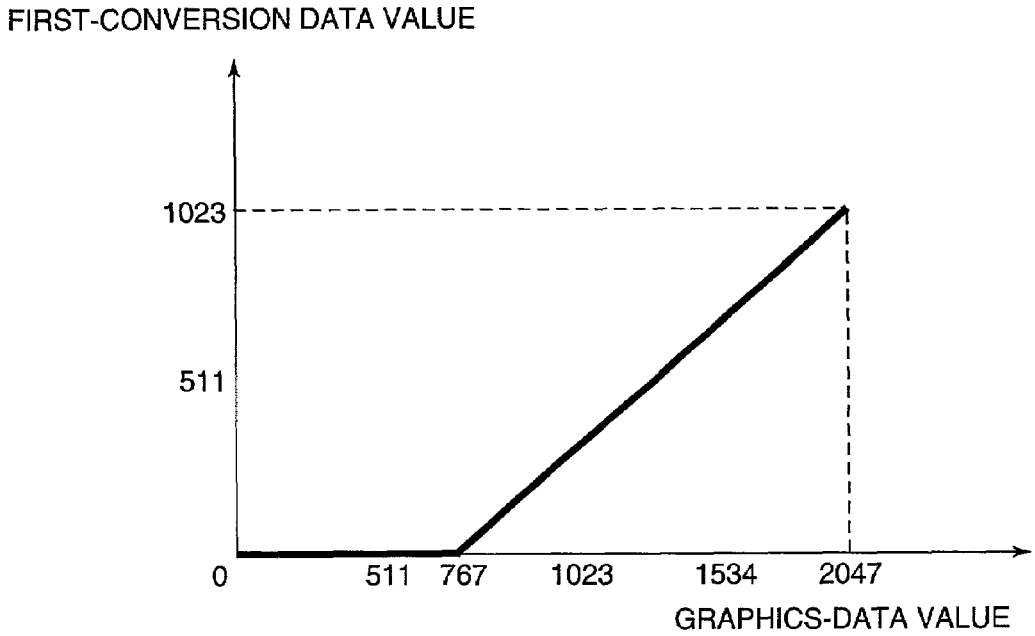
FIG. 11(*a*) is a view showing the input and output characteristic of a first conversion table 3061 used in the liquid-crystal display device.
Figure 11:
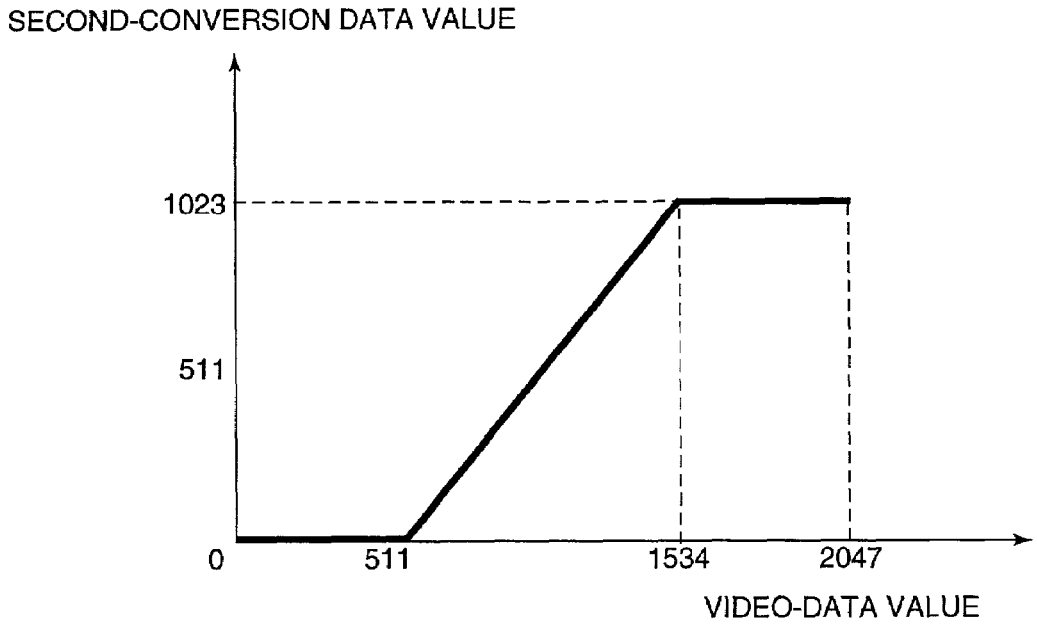

The first conversion table 3061 is used to convert graphics data Db1, and the second conversion table 3062 is used to convert video data Db2. FIG. 11(*a*) is a view showing the input and output characteristic of the first conversion table, and FIG. 11(*b*) is a view showing the input and output characteristic of the second conversion table.

Figure 9:
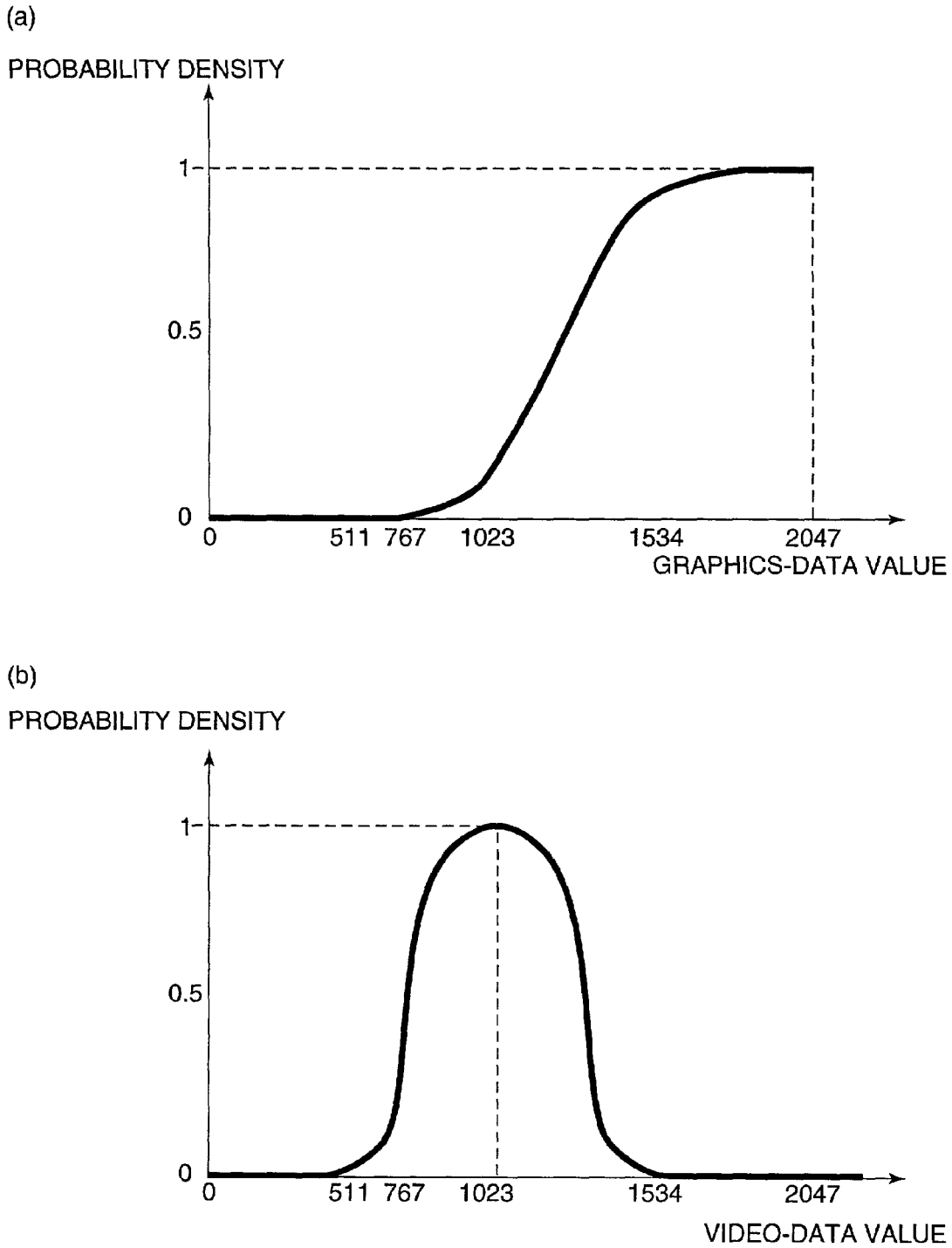
FIG. 9(*a*) is a view showing the probability density distribution of the data values of graphics data Db1.

As shown in FIG. 11(*a*), the first conversion table 3061 converts graphics data Db1 having data values of 768 to 2047 to the first conversion data Dx1 having data values of 1 to 1023 with one to one correspondence, and converts graphics data Db1 having data values of 0 to 767 to the first conversion data Dx1 having a data value of 0. The input and output characteristic of the first conversion table 3061 has been specified as described above because the data values of graphics data Db1 are almost distributed in a range from 767 to 2047, and a probability at which its data value is 766 or less is very low, as shown in FIG. 9(*a*).

As shown in FIG. 11(*b*), the second conversion table 3062 converts video data Db2 having data values of 512 to 1533 to the second conversion data Dx2 having data values of 1 to 1022 with one to one correspondence, converts video data Db2 having data values of 0 to 511 to the second conversion data Dx2 having a data value of 0, and converts video data Db2 having data values of 1534 to 2047 to the second conversion data Dx2 having a data value of 1023. The input and output characteristic of the second conversion table 3062 has been specified as described above because the data values of video data Db2 are almost distributed in a range from 511 to 1534, and a probability at which its data value is 510 or less, or 1535 or more is very low, as shown in FIG. 9(*b*).

In other words, the data-value conversion circuit 306 takes out data values which have high occurrence frequencies among the data values (0 to 2047) of input image data Db, and converts them to 10-bit converted image data Dx. With this operation, the data-value conversion circuit 306 generates the 10-bit converted image data Dx without reducing the quality of the 11-bit input image data Db.

In the output-range-control-signal generating circuit 304, the selection circuit 3042 selects the third output-range setting voltage V3 when the data-type control signal CTLd has the H level, and selects the fourth output-range setting voltage V4 when the data-type control signal CTLd has the L level to generate the output-range control signal CTLout, and sends it to the control input terminal 301T of the D/A converter 301. Therefore, when input image data Db is graphics data Db1, the third output-range setting voltage V3 determines the output range of the D/A converter 331. When input image data Db is video data Db2, the fourth output-range setting voltage V4 determines the output range of the D/A converter 301.

Figure 12:
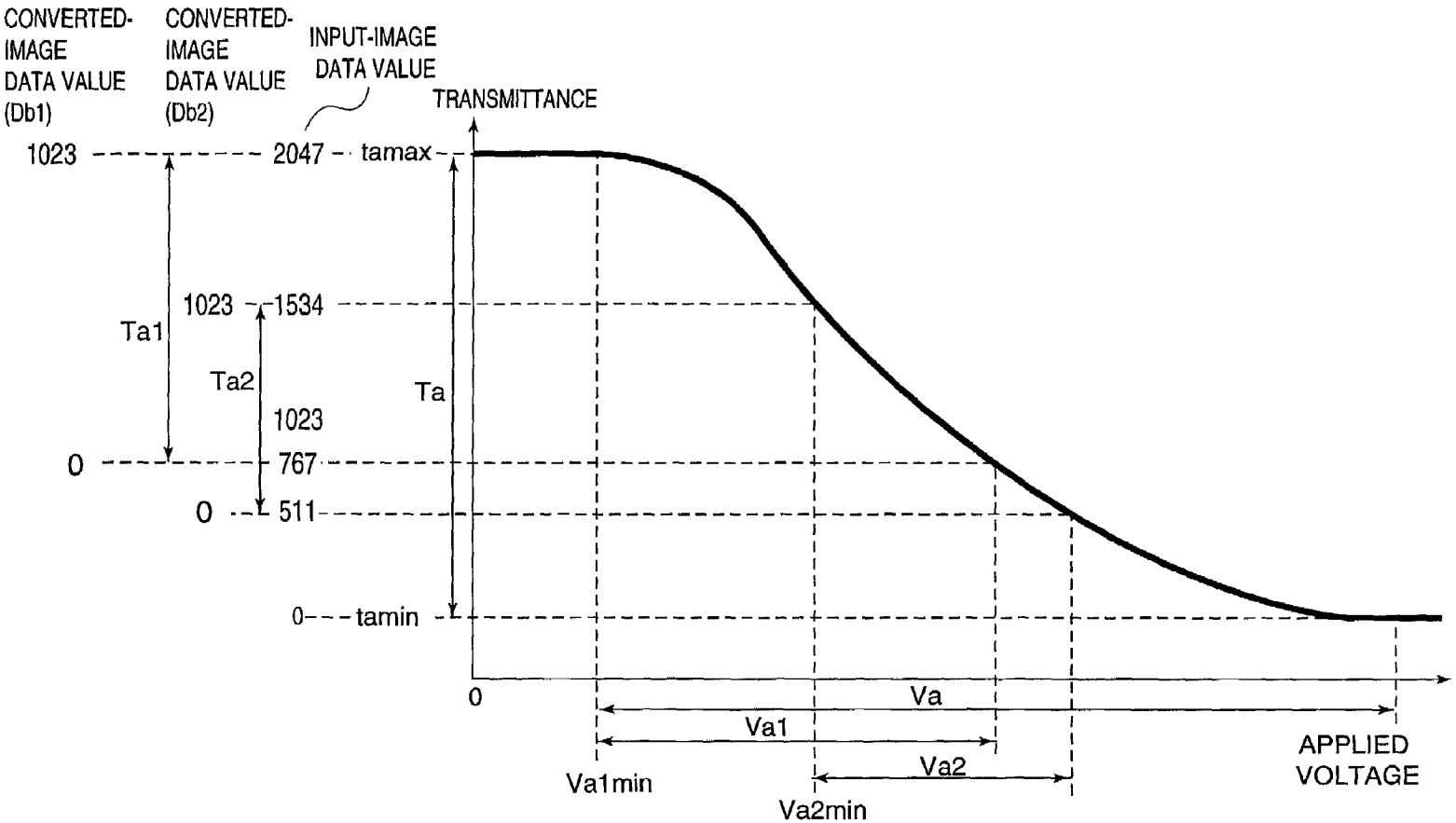
FIG. 12 is a view showing the first V-T characteristic of the liquid-crystal display panel 100A used in the liquid-crystal display device.

FIG. 12 is a view showing the first V-T characteristic of the liquid-crystal display panel 100A. As described above, the data-value conversion circuit 306 converts the data values of input image data Db according to the data type to generate converted image data Dx. When input image data Db is graphics data Db1, data values 767 to 2047 of the graphics data Db1, corresponding to a transmittance range Ta1, are assigned to converted image data values 0 to 1023. On the other hand, when input image data Db is video data Db2, data values 511 to 1534 of the video data Db2, corresponding to a transmittance range Ta2, are assigned to converted image data values 0 to 1023. Therefore, it is necessary that the applied-voltage range of the liquid crystal be set to Va1 when input image data Db is graphics data Db1, and the applied-voltage range of the liquid crystal be set to Va2 when input image data Db is vide data Db2.

The third output-range setting voltage V3 described above is selected such that, when it is applied to the control input terminal 301T, the applied-voltage range finally applied to the liquid crystal is the range Va1 shown in FIG. 12. The fourth output-range setting voltage V4 described above is selected such that, when it is applied to the control input terminal 301T, the applied-voltage range finally applied to the liquid crystal is the range Va2 shown in FIG. 12.

Figure 13:
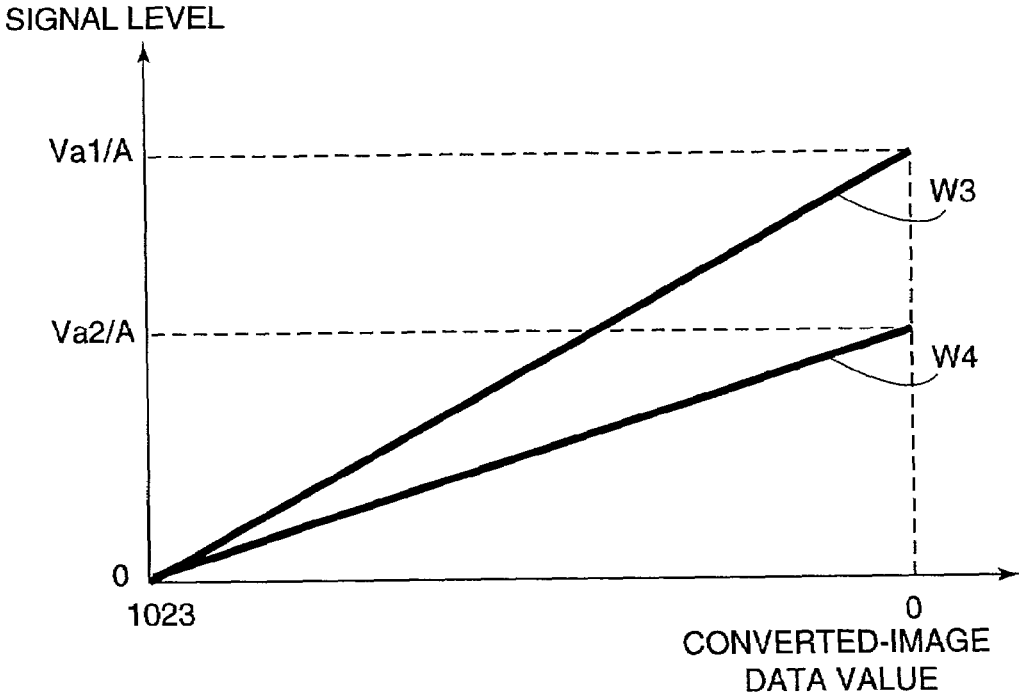
FIG. 13 is a view showing the input and output characteristic of a D/A converter 301 used in the liquid-crystal display device.

Since the total gain of the phase-development circuit 302 and the amplification and inversion circuit 303 is A or −A, the output range of the D/A converter 301 is specified with a gain of A being taken into consideration. FIG. 13 is a view showing the input and output characteristic of the D/A converter 301. In the figure, a characteristic W3 indicates an input and output characteristic obtained when the third output-range setting voltage V3 is applied, and a characteristic W4 indicates an input and output characteristic obtained when the fourth output-range setting voltage V4 is applied. It is clear from the characteristics W3 and W4 that the output range of the D/A converter 301 is obtained by dividing the applied-voltage ranges Va1 and Va2 determined according to the data type by a gain of A. Therefore, the output range of the D/A converter 301 can be adjusted correspondingly to the applied-voltage range determined by the data type.

The third positive-polarity reference voltage Vp3, the fourth positive-polarity reference voltage Vp4, the third negative-polarity reference voltage Vn3, and the fourth negative-polarity reference voltage Vn4 generated by the second power-supply circuit 3051 of the reference-signal generating circuit 305 will be described next. The third positive-polarity reference voltage Vp3 is obtained by adding a first minimum applied voltage Va1min shown in FIG. 12 to the first opposing-electrode voltage Vc1 applied to the opposing substrate of the liquid-crystal display panel 100A, and the third negative-polarity reference voltage Vn3 is obtained by subtracting the first minimum applied voltage Va1min from the first opposing-electrode voltage Vc1. The fourth positive-polarity reference voltage Vp4 is obtained by adding a second minimum applied voltage Va2min shown in FIG. 12 to the first opposing-electrode voltage Vc1, and the fourth negative-polarity reference voltage Vn4 is obtained by subtracting the second minimum applied voltage Va2min from the first opposing-electrode voltage Vc1.

Figure 14:
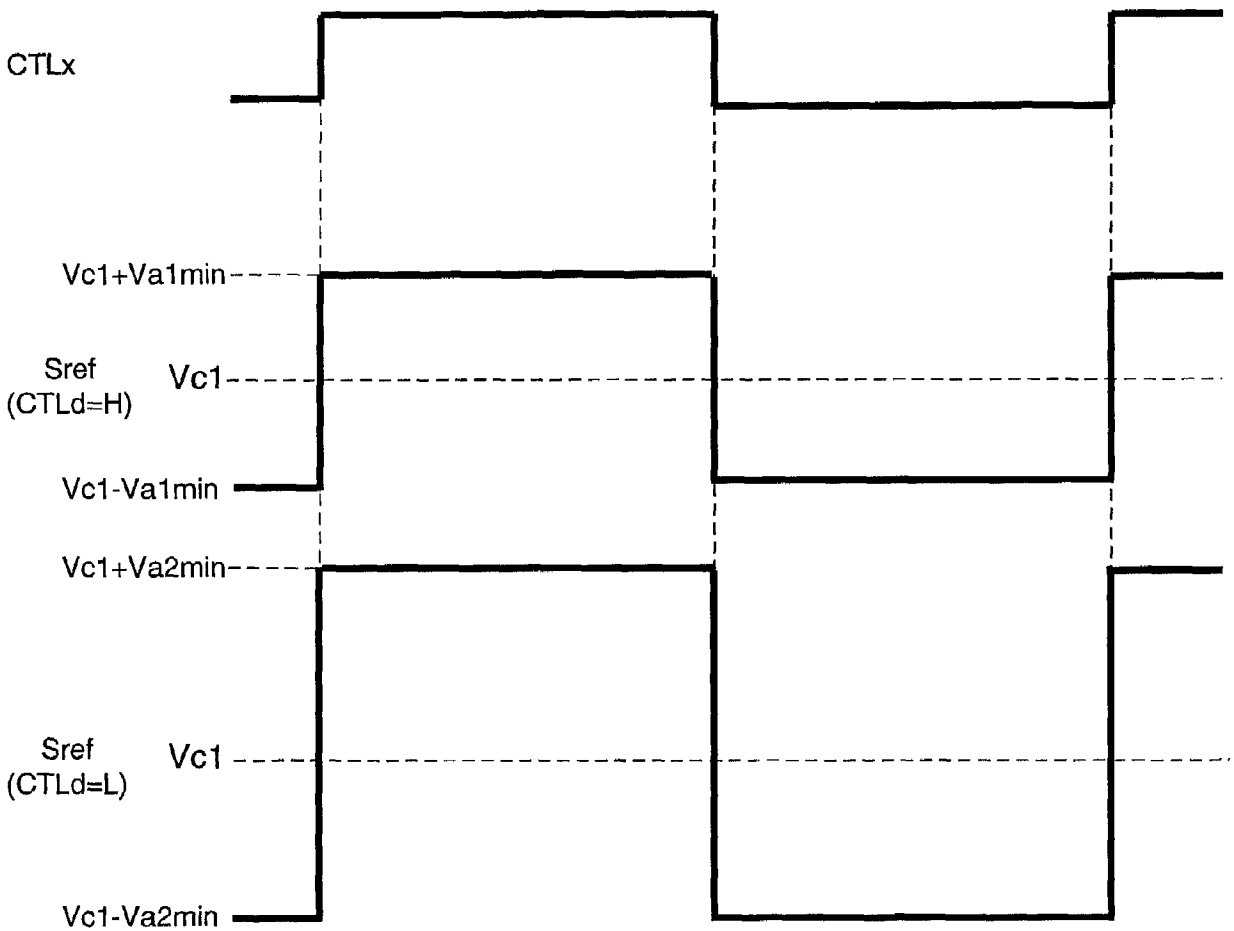
FIG. 14 is a timing chart showing the waveforms of a polarity control signal CTLx and a reference signal Sref in the liquid-crystal display device.
Figure 15:
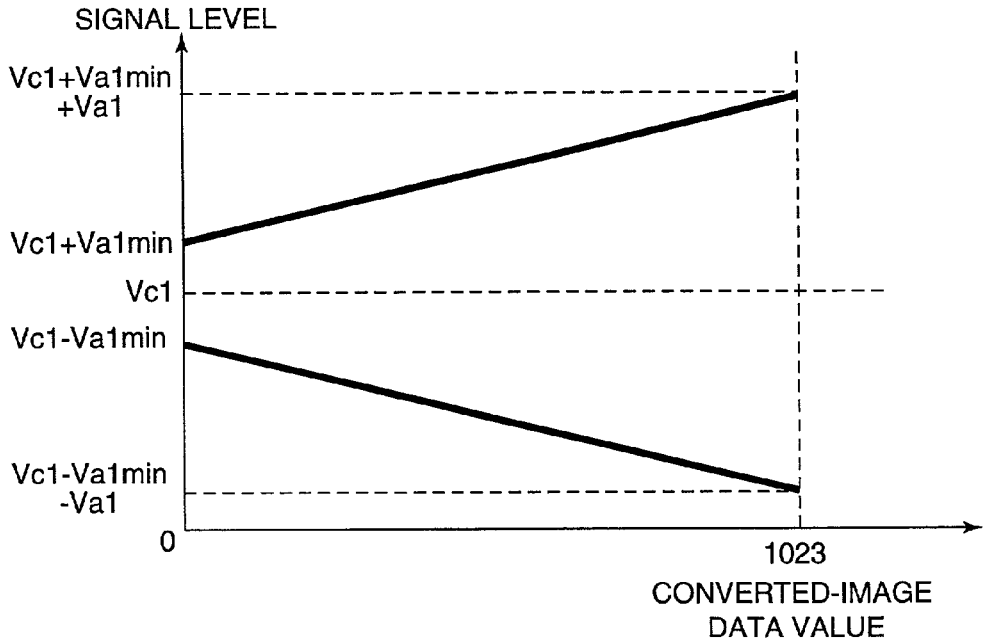
FIG. 15(*a*) is a view showing the input and output characteristic of an image-signal processing circuit 300B, used when input image data Db is graphics data Db1.
Figure 15:
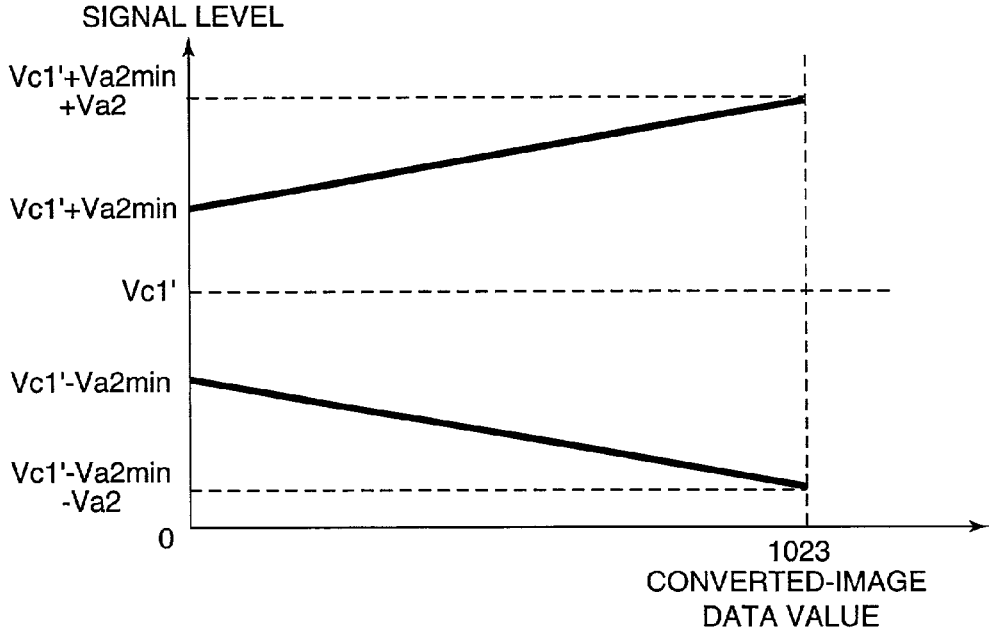

FIG. 14 shows a reference signal Sref obtained by selecting the voltages Vp3, Vp4, Vn3, and Vn4 according to the data-type control signal CTLd and the polarity control signal CTLx. Since the output phase-development image signal VID1 is obtained by adding the inverted image signal vid1' to the reference signal Sref, when input image data Db is graphics data Db1, the input and output characteristic of a portion ranging from the input of the D/A converter 301 to the output of the amplification and inversion circuit 303 is that shown in FIG. 15(*a*). When input image data Db is video data Db2, the input and output characteristic is that shown in FIG. 15(*b*).

The operation of the liquid-crystal display device will be described next. When the timing circuit 200A generates the data-type control signal CTLd according to the vertical synchronization signal VB, the data-value conversion circuit 306 converts 11-bit input image data Db to 10-bit converted image data Dx according to the data-type control signal CTLd. Since this conversion processing assigns the input image data Db to the converted image data Dx with the data-value distribution of the input image data Db being taken into consideration, the converted image data Dx substantially has a precision of 11 bits.

The output-range-control-signal generating circuit 304 selects either the third output-range setting voltage V3 or the fourth output-range setting voltage V4 according to the data-type control signal CTLd to generate the output-range control signal CTLout. Since the input and output characteristic of the D/A converter 301 is determined by the output-range control signal CTLout sent to the control input terminal 301T, when input image data Db is graphics data Db1, the characteristic W3 is specified, and when input image data Db is video data Db2, the characteristic W4 is specified (see FIG. 13). The nature of input image data Db depends on the type of the data, and its data values are biased. According to the present embodiment, since the output range of the D/A converter 301 can be adjusted according to the type of the data, the output range of the D/A converter 301 can be adjusted according to the biased condition of the data values.

Since a range of transmittance used for displaying gray scale images depends on the type of input image data Db, the minimum voltage applied to the liquid crystal also depends on it. With this condition being taken into consideration, the reference signal Sref is generated by selecting the third positive-polarity reference voltage Vp3, the fourth positive-polarity reference voltage Vp4, the third negative-polarity reference voltage Vn3, and the fourth negative-polarity reference voltage Vn4. Therefore, when input image data Db is graphics data Db1, the transmittance range Ta1 can be used, and when input image data Db is video data Db2, the transmittance range Ta2 can be used, as shown in FIG. 12.

A comparison case is assumed here in which high-order 10 bits are extracted from 11-bit input image data Db to generate converted image data Dx, and it is assigned to the applied-voltage range Va. Since one-bit information is lost during a conversion process in this comparison case, a change in the applied voltage per bit of the input image data Db is Va/1024. In contrast, in the present embodiment, since the information of input image data Db is not lost during the data-value conversion process, and the range of voltages applied to the liquid crystal is set to Va1 or Va2, a change in the applied voltage per bit of the input image data Db can be reduced. When the input image data Db is graphics data Db1, a change in the applied voltage is Va1/2048. When the input image data Db is video data Db2, the amount of change in the applied voltage is Va2/2048. When Va1/Va and Va2/Va are set to ¾ and ¼, respectively, the change in the applied voltage per bit is three eighth that in the comparison case when graphics data Db1 is displayed, and the change in the applied voltage per bit is one eighth that in the comparison case when video data Db2 is displayed.

Therefore, according to the present embodiment, high-definition images can be displayed according to the type of input data.

A liquid-crystal display device according to a third embodiment will be described next. The liquid-crystal display device according to the third embodiment changes a transmittance range according to the mean value of input image data Da.

Figure 16:
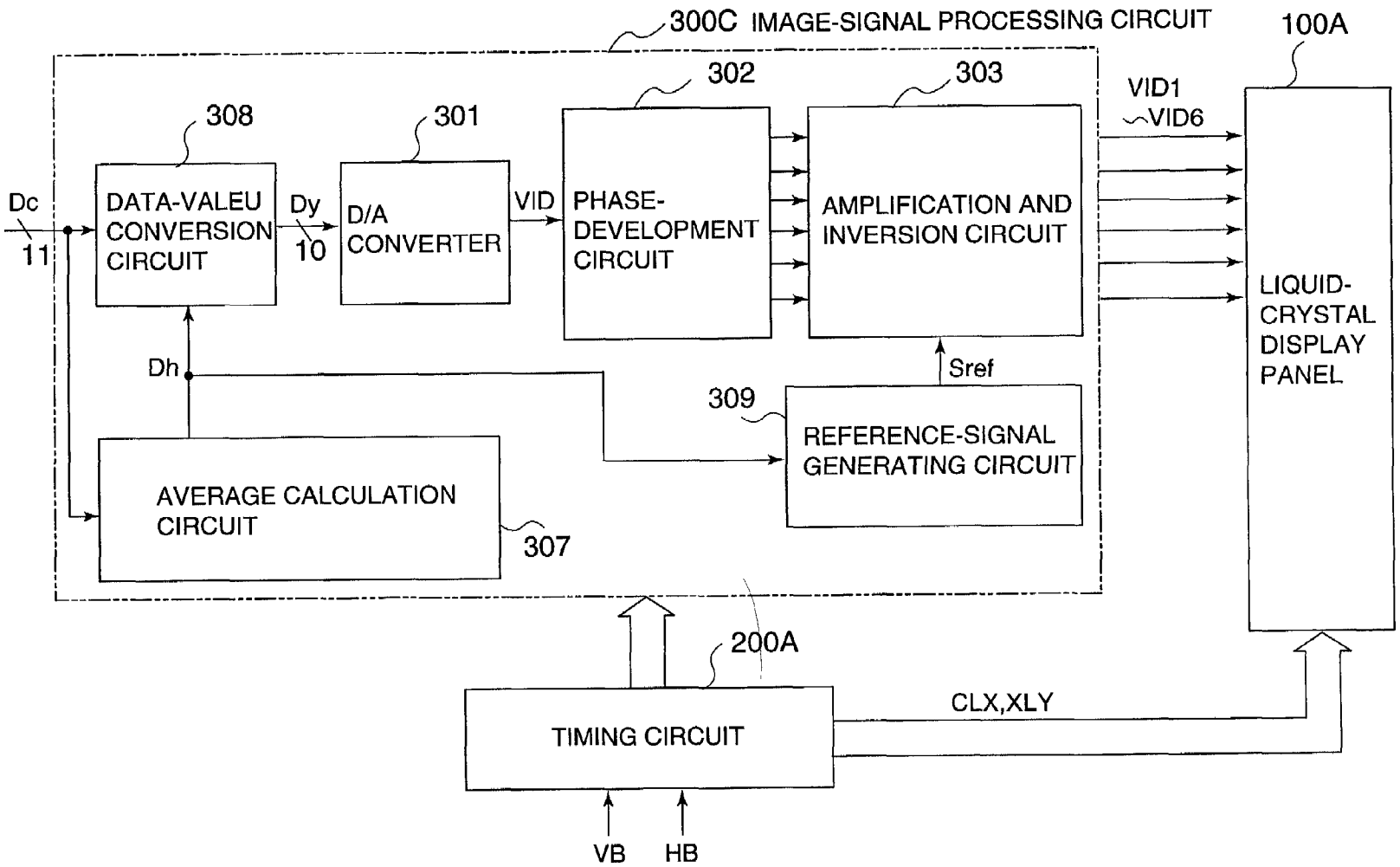
FIG. 16 is an exemplary block diagram showing the entire structure of a liquid-crystal display device according to a third embodiment of the present invention.

FIG. 16 is an exemplary block diagram showing the structure of the liquid-crystal display device according to the third embodiment. The liquid-crystal display device shown in the figure is almost the same as the liquid-crystal display device of the first embodiment shown in FIG. 1, except that an image-signal processing circuit 300C is used instead of the image-signal processing circuit 300A and the timing circuit 200A does not generate the panel-type control signal CTLp indicating the type of a liquid-crystal display panel used.

Figure 17:
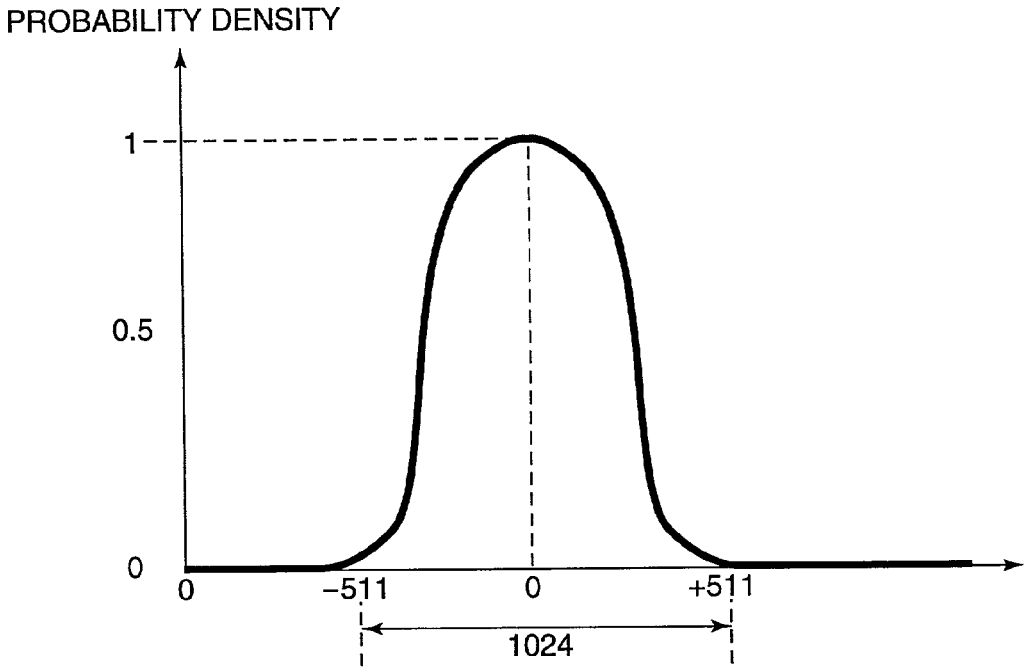
FIG. 17 is a view showing the distribution characteristic of the data values of input image data in one screen.

Input image data Dc input to the liquid-crystal display apparatus is of a 11-bit parallel type. The input image data Dc is video data obtained by applying A/D conversion to a video signal obtained by capturing an object by a video camera. The captured video has a bright portion and a dark portion in one screen. The gray levels of pixels constituting one screen are not distributed from the maximum luminance (saturated white) to the minimum luminance (saturated black) but are distributed in a certain range having its center at the mean gray level of one screen. FIG. 17 is a view showing the distribution characteristic of input image data values on one screen. In this figure, the input image data values are normalized with the mean data value in the screen being set to 0, and a probability density is normalized with its maximum value being set to 1.

As shown in the figure, the data values of the input image data Dc are almost distributed in a range of ±511 with the mean value in one screen being set to the center. Therefore, it is understood that the difference between the maximum value and the minimum value of input image data Dc in a screen is 1024 or less, and the distribution range of data values can be determined by the mean value of input image data Dc.

As shown in FIG. 16, the image-signal processing circuit 300C according to the third embodiment differs from the image-signal processing circuit 300A of the first embodiment shown in FIG. 1 in that an mean value calculation circuit 307, a data-value conversion circuit 308, and a reference-signal generating circuit 309 are provided, and that the reference-signal generating circuit 305 and the output-range control circuit 304 are excluded. A predetermined voltage is input to the control input terminal 301T of the D/A converter 301. Therefore, the output range of the D/A converter 301 is not changed unlike those used in the first and second embodiment but is fixed. In the present embodiment, the output range is Vx/A when the range of voltages finally applied to the liquid crystal is Vx (Vx1 to Vx2), where A indicates the total gain of the phase-development circuit 302 and the amplification and inversion circuit 303 as in the first and second embodiments.

The mean value calculation circuit 307 calculates the mean value of input image data Dc in one screen, and generates mean value data Dh indicating the calculated mean value.

Figure 18:
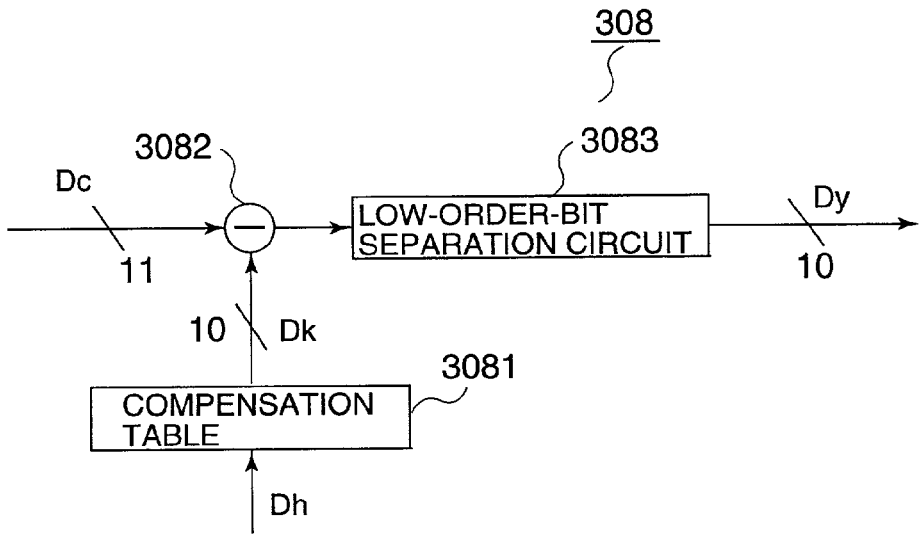
FIG. 18 is an exemplary block diagram of a data-value conversion circuit 308 used in the liquid-crystal display device.

The data-value conversion circuit 308 converts 11-bit input image data Dc to 10-bit converted image data Dy according to the mean value data Dh. FIG. 18 is an exemplary block diagram showing the structure of the data-value conversion circuit 308. As shown in the figure, the data-value conversion circuit 308 includes a compensation table 3081, a subtraction circuit 3082, and a low-order-bit separation circuit 3083.

The compensation table 3081 is formed of a ROM having an 11-bit input and a 10-bit output, and stores 10-bit compensation data Dk related to the data value of each mean value data Dh. Therefore, when a certain mean value data Dh is used as a reading address, the compensation data Dk corresponding to the mean value specified by the mean value data Dh is read from the compensation table 3081.

Figure 19:
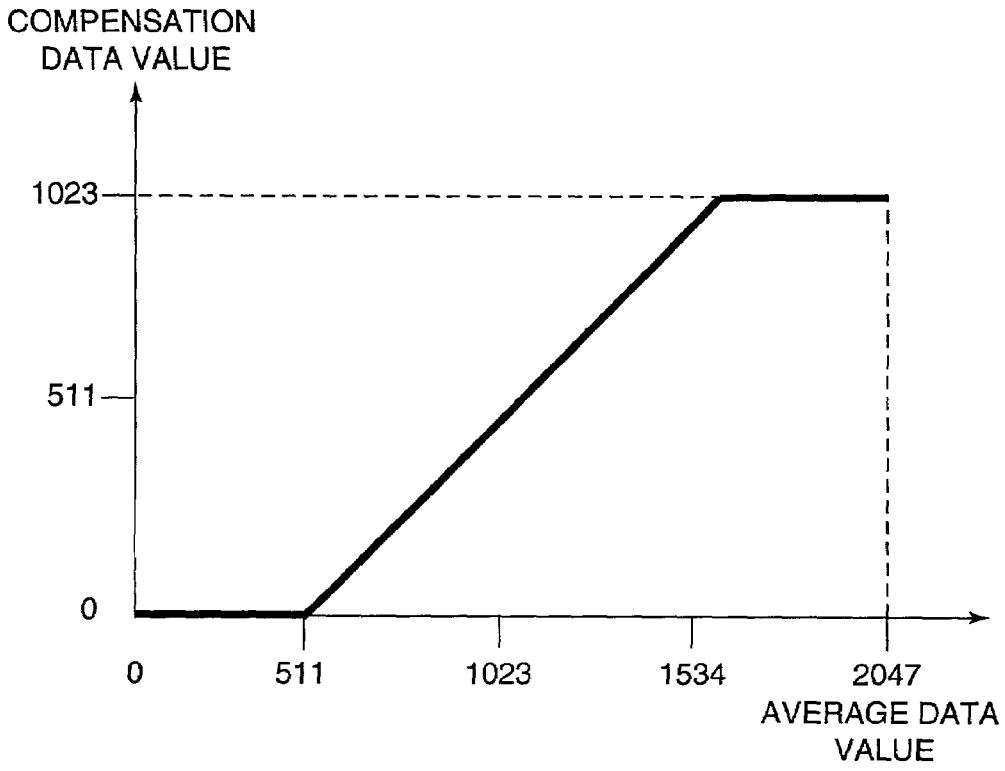
FIG. 19 is a view showing the input and output characteristic of a compensation table 3081 used in the liquid-crystal display device.

FIG. 19 is a view showing the input and output characteristic of the compensation table. As shown in the figure, when the data value of the mean value data Dh is 511 or less, the data value of the corresponding compensation data Dk is 0, when the data value of the mean value data Dh ranges from 512 to 1533, the data value of the corresponding compensation data Dk ranges from 2 to 1022, and when the data value of the mean value data Dh is 1534 or more, the data value of the corresponding compensation data Dk is 1023.

The subtraction circuit 3082 subtracts the compensation data Dh from the input image data Dc and outputs the result. The low-order-bit separation circuit 3083 separates 10 low-order bits from the data output from the subtraction circuit 3082, and outputs them as converted image data Dy.

Figure 20:
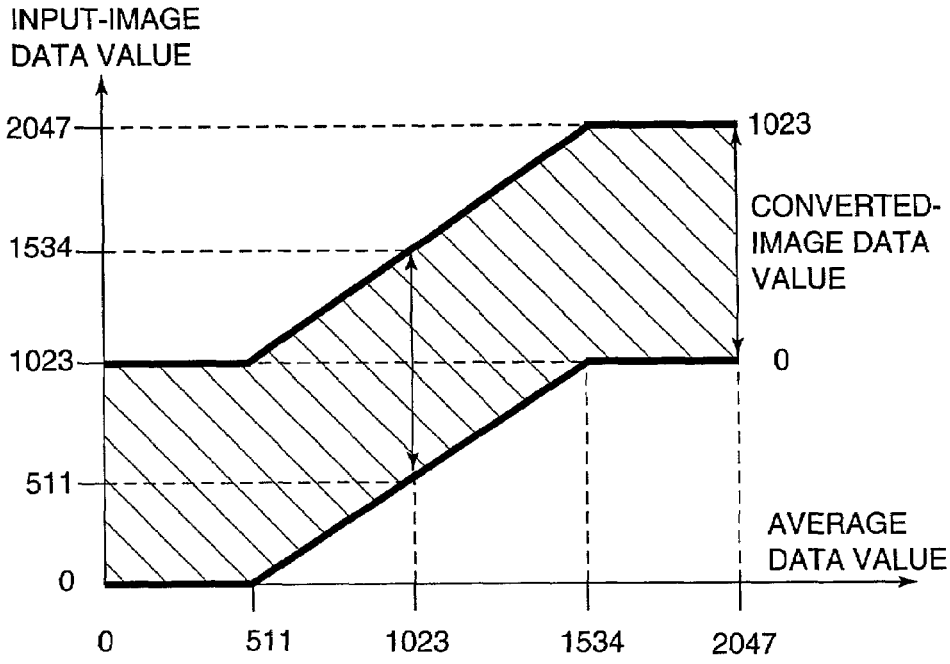
FIG. 20 is a view showing a range where input image data Dc is assigned to converted image data Dy in the liquid-crystal display device.

With these operations, 11-bit input image data Dc is converted to 10-bit converted image data Dy according to the mean value in one screen. FIG. 20 is a view showing ranges where input image data is assigned to converted image data. In this figure, a slanted portion indicates a range of converted image data Dy extracted from the original input image data Dc.

When the mean value data Dh has a value of 1023, for example, the corresponding compensation data Dk has a value of 511 (see FIG. 19). As described above, since the data values of input image data Dc are distributed in a range of ±511 with the mean value in a screen being placed at the center, when the mean has a value of 511, the data values of input image data Dc are distributed in a range from 511 to 1534.

Since converted image data Dy is obtained by subtracting compensation data Dk from input image data Dc, when input image data Dc has a value of 511, the converted image data Dy has a value of 0, and when input image data Dc has a value of 1534, the converted image data Dy has a value of 1023.

Figure 21:
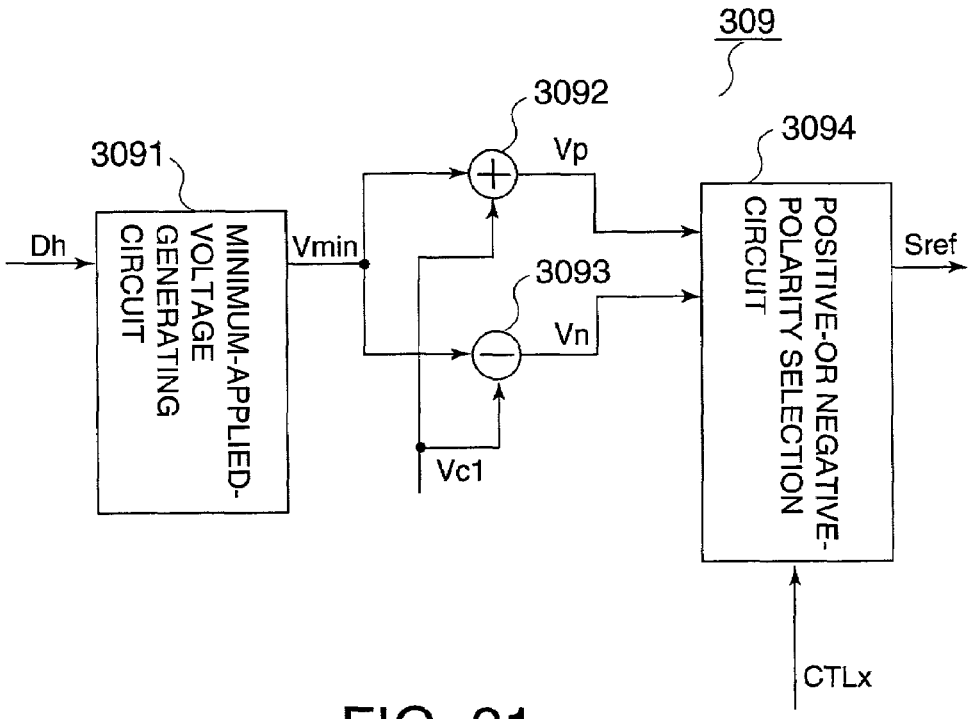
FIG. 21 is an exemplary block diagram of a reference-signal generating circuit 309 used in the liquid-crystal display device.

The reference-signal generating circuit 309 generates a reference signal Sref which inverts its polarity in synchronization with a polarity control signal CTLx according to mean value data Dh and a first opposing-electrode voltage Vc1. FIG. 21 is a block diagram showing the structure of the reference-signal generating circuit 309. As shown in the figure, the reference-signal generating circuit 309 includes a minimum-applied-voltage generating circuit 3091, an adder circuit 3092, a subtraction circuit 3093, and a positive- or negative-polarity selection circuit 3094.

The minimum-applied-voltage generating circuit 3091 generates a minimum voltage Vmin to be applied to liquid crystal, according to mean value data Dh. When the liquid-crystal display panel 100A operates in a normally white mode as in the present embodiment, the minimum applied voltage Vmin determines the maximum transmittance, that is, the maximum gray scale value. In addition, as described above, the mean gray scale value in the entire screen determines the maximum gray scale value in the screen. Therefore, when the mean value is found in a screen, the minimum applied voltage Vmin can be determined. The minimum-applied-voltage generating circuit 3091 includes a D/A converter (not shown), and a storage section (not shown) storing mean value data Dh and the minimum-applied-voltage data related to each other. The minimum-applied-voltage generating circuit 3091 applies D/A conversion to the minimum-applied-voltage data to generate the minimum applied voltage Vmin. The minimum applied voltage Vmin is Vx2 when mean value data Dh ranges from 0 to 511, the minimum applied voltage Vmin decreases when the mean value data Dh ranges from 512 to 1533, and the minimum applied voltage Vmin is Vx1 when the mean value data Dh ranges from 1534 to 2047 in the present embodiment, as indicated by a one-dot chain line in FIG. 23.

The adder circuit 3092 adds the minimum applied voltage Vmin to the first opposite-electrode voltage Vc1 to output a positive-polarity reference voltage Vp whereas the subtraction circuit 3093 subtracts the minimum applied voltage from the first opposing-electrode voltage Vc1 to output a negative-polarity reference voltage Vn.

The positive- or negative-polarity selection circuit 3094 selects the positive-polarity reference voltage Vp when the polarity control signal CTLx has the H level, and selects the negative-polarity reference voltage Vn when the polarity control signal CTLx has the L level to generate the reference signal Sref.

Figure 22:
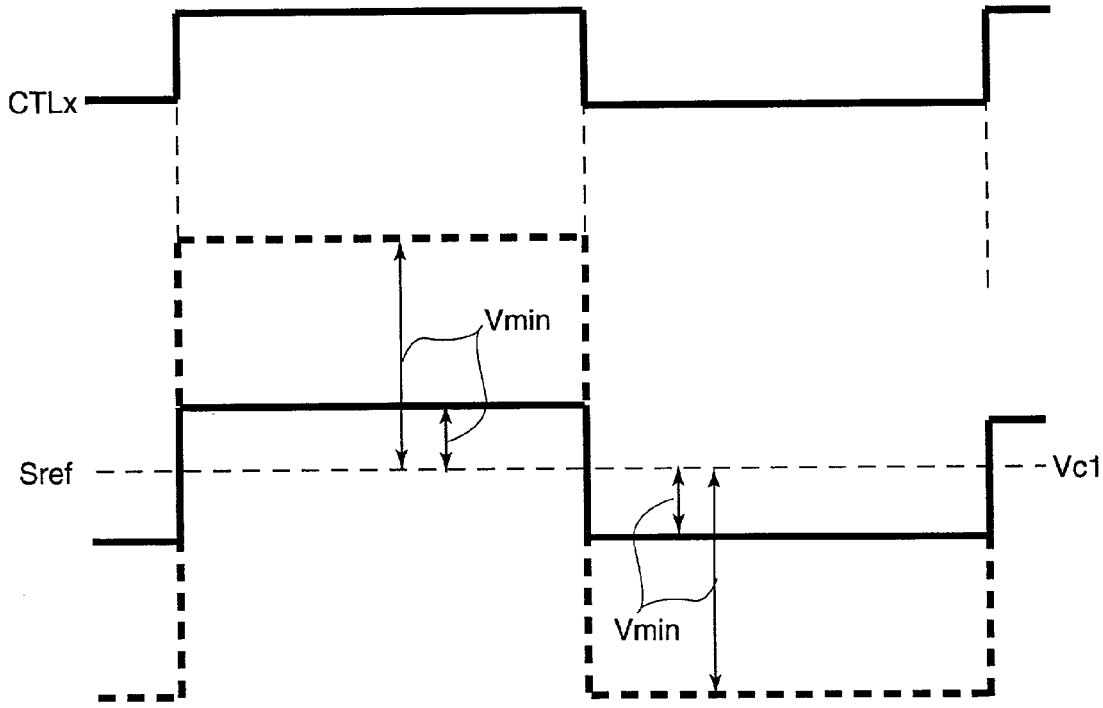
FIG. 22 is a timing chart showing the waveforms of a polarity control signal CTLx and a reference signal Sref in the liquid-crystal display device.

Therefore, the reference signal Sref inverts its polarity with the first opposing-electrode voltage Vc1 being used as a reference. FIG. 22 is a timing chart showing the waveforms of the reference signal Sref and the polarity control signal CTLx. Since the minimum applied voltage Vmin is changed according to the mean value data Dh, the waveform of the reference signal Sref is dynamically changed according to the mean value data Dh as shown in the figure.

The operation of the liquid-crystal display device will be described next. When input image data Dc is sent from an external device to the mean value calculation circuit 307, the mean value calculation circuit 307 calculates the mean value of the input image data Dc for one field to generate mean value data Dh. The data-value conversion circuit 308 converts the 11-bit input image data Dc to 10-bit converted imaged data Dx according to the mean value data Dh. Since the input image data Dc is assigned to the converted image data Dy with the data-value distribution of the input image data Dc based on the mean value in one screen being taken into consideration, in this conversion processing, the converted image data Dy substantially has a precision of 11 bits.

Figure 23:
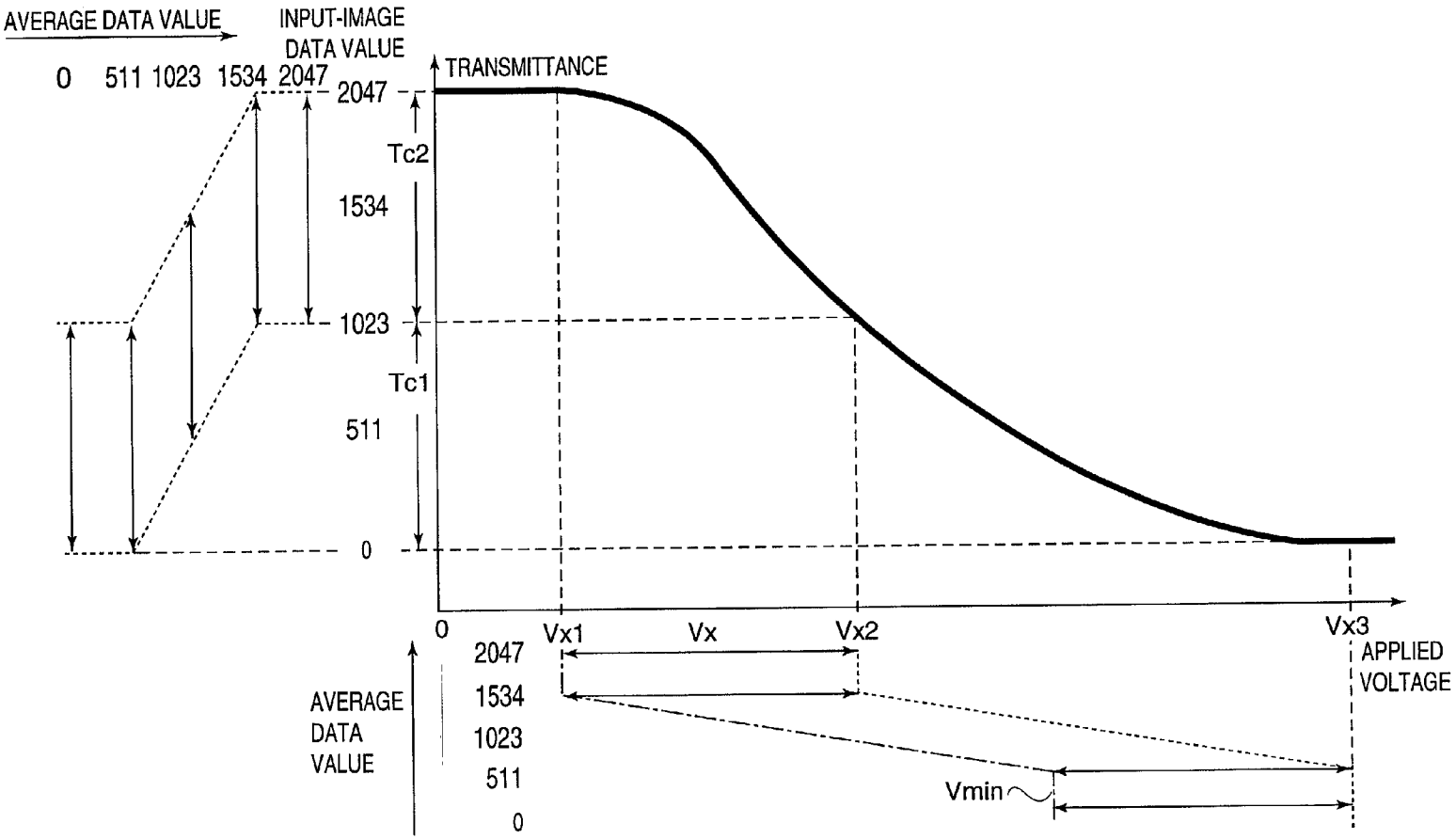
FIG. 23 is a view showing mutual relationships among a first V-T characteristic, an effective range of input image data, and average data.

Since the range where the 11-bit input image data Dc is assigned to the 10-bit converted image data Dx is changed as shown in FIG. 20 according to the value of the mean value data Dh, the range of voltages applied to the liquid crystal needs to be changed according to the value of the mean value data Dh. This point will be described below by referring to FIG. 23. FIG. 23 is a view showing mutual relationships among a first V-T characteristic, the effective range of input image data, and mean value data.

When the mean value data Dh ranges from 0 to 511, the input image data Dc ranges from 0 to 1023. The corresponding transmittance range is indicated by Tc1 in the figure. To obtain the transmittance range Tc1, a voltage applied to the liquid crystal needs to be changed from Vx2 to Vx3. As described above, when the mean value data Dh ranges from 0 to 511, since the minimum applied voltage Vmin is Vx2 and the output range of the D/A converter 301 is Vx/A, this condition is satisfied.

When the mean value data Dh ranges from 512 to 1533, the range of the values of the input image data Dc is changed from the range 0 to 1023 to a range 1023 to 2047. In this case, since the corresponding transmittance range is changed from Tc1 to Tc2, the range of voltages applied to the liquid crystal needs to be changed from Vx2 to Vx3 to from Vx1 to Vx2. As described above, when the mean value data Dh ranges from 512 to 1533, since the minimum applied voltage Vmin is changed from Vx2 to Vx1, and the output range of the D/A converter 301 is Vx/A, this condition is satisfied.

When the mean value data Dh ranges from 1534 to 2047, the input image data Dc ranges from 1023 to 2047. The corresponding transmittance range is indicated by Tc2 in the figure. To obtain the transmittance range Tc2, a voltage applied to the liquid crystal needs to be changed from Vx1 to Vx2. As described above, when the mean value data Dh ranges from 1534 to 2047, since the minimum applied voltage Vmin is Vx1 and the output range of the D/A converter 301 is Vx/A, this condition is satisfied.

In other words, according to the present embodiment, input image data Dc is converted according to the mean value of an image to generate converted image data Dy. The D/A converter 301 having a fixed output range applies D/A conversion to the converted image data Dy to generate an image signal VID; and the minimum applied voltage Vmin is generated according to the mean value of the image and the reference voltage Sref is generated according to the minimum applied voltage Vmin. Therefore, the bits of the input image data Dc can be assigned to a transmittance range effective for displaying the image.

It should be understood that the present invention is not limited to the above-described embodiments. For example, the following modifications are possible.

(1) In the above-described first embodiment, the second power-supply circuit 3051 of the reference-signal generating circuit 305 generates the positive-polarity voltages Vp1 and Vp2, and the negative-polarity voltages Vn1 and Vn2. Specifically, there are two forms. In a first form, the second power-supply circuit 3051 is formed of voltage sources which generate the voltages Vp1, Vp2, Vn1, and Vn2. In this form, when the display panel 100 operates in a normally white mode, voltages corresponding to a white level are directly generated.

In a second form, the second power-supply circuit 3051 can be formed of first and second voltage sources, a subtraction section, and an adder section. The first voltage source generates a first voltage which is higher than a reference potential determined in advance according to the type of an electro-optical panel used, by a maximum applied voltage determined in advance according to the type of the electro-optical panel. The second voltage source generates a second voltage which is lower than the reference potential by the maximum applied voltage. The subtraction section subtracts a change voltage determined in advance according to the type of the electro-optical panel used, from the first voltage to generate the positive-polarity reference voltage. The adder section adds the change voltage to the second voltage to generate a negative-polarity reference voltage. The maximum applied voltage is the highest voltage required to be applied to an electro-optical material to obtain a transmittance range used for displaying images, according to the type of the electro-optical panel used.

In this form, when the display panel 100 operates in a normally white mode, the first voltage and the second voltage corresponding to a black level (minimum transmittance) are generated, and the positive-polarity reference voltage and the negative-polarity reference voltage are generated according to the first voltage, the second voltage, and the change voltage applied to the electro-optical material.

(2) Also in the above-described second embodiment, there are two forms in configuring the second power-supply circuit 3051 in the same way as for the above modifications. In a first form, the second power-supply circuit 3051 is formed of voltage sources which generate the voltages Vp1, Vp2, Vn1, and Vn2. In this form, when the display panel 100 operates in a normally white mode, voltages corresponding to a white level are directly generated.

In a second form, the second power-supply circuit 3051 is formed of first and second voltage sources, a subtraction section, and an adder section. The first voltage source generates a first voltage which is higher than a reference potential determined in advance according to the type of input image data, by a maximum applied voltage determined in advance according to the type of the input image data. The second voltage source generates a second voltage which is lower than the reference potential by the maximum applied voltage. The subtraction section subtracts a change voltage determined in advance according to the type of the input image data, from the first voltage to generate the positive-polarity reference voltage. The adder section adds the change voltage to the second voltage to generate a negative-polarity reference voltage. The maximum applied voltage is the highest voltage required to be applied to an electro-optical material to obtain a transmittance range used for displaying images, according to the type of the input image data. In this form, when the display panel 100 operates in a normally white mode, the first voltage and the second voltage corresponding to a black level (minimum transmittance) are generated, and the positive-polarity reference voltage and the negative-polarity reference voltage are generated according to the first voltage, the second voltage, and the change voltage applied to the electro-optical material.

Some example applications in which the liquid-crystal display device described in each of the above-embodiments are used in an electronic apparatus will be described next.

Figure 24:
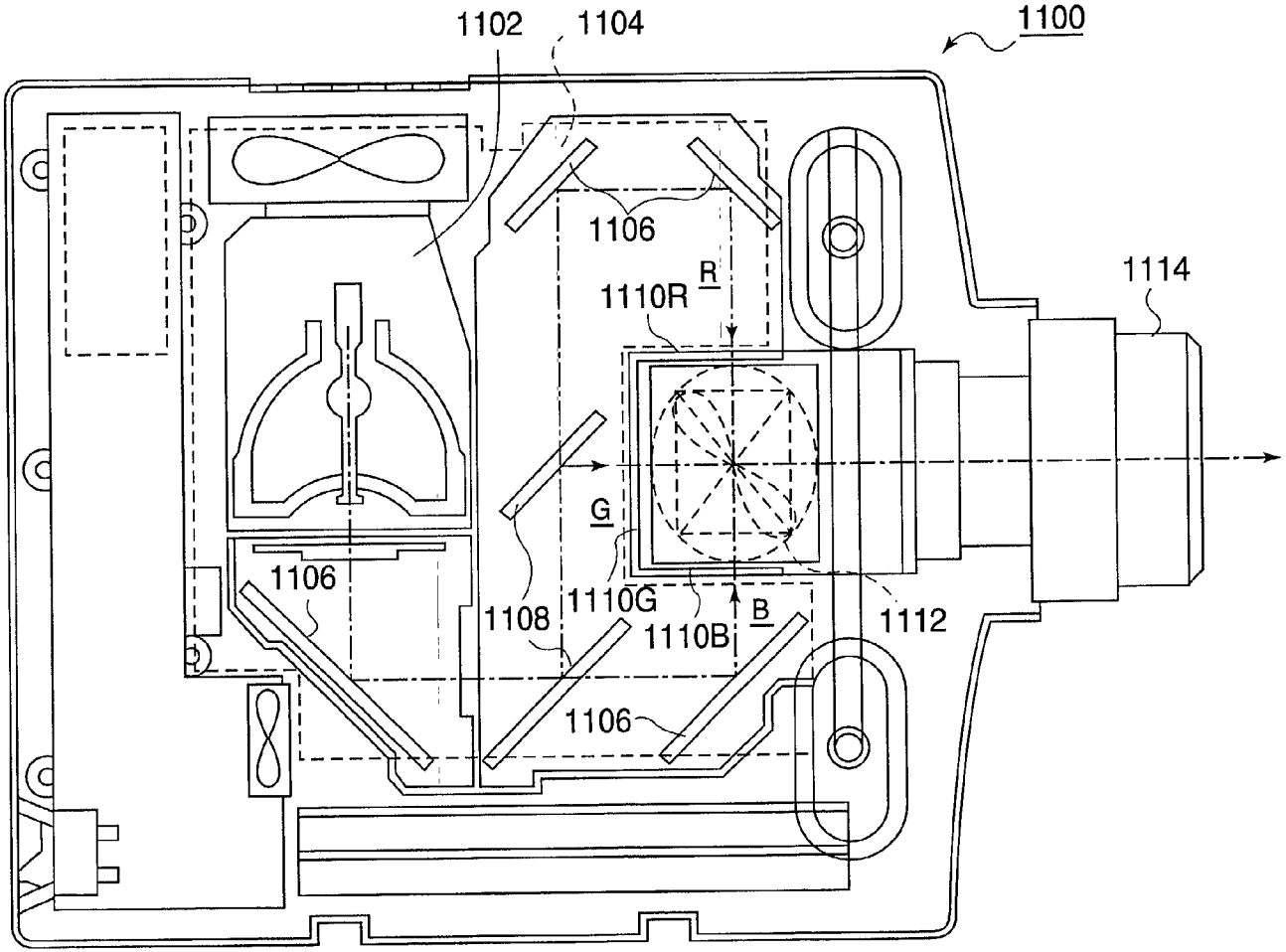
FIG. 24 is a cross-sectional view showing the structure of a projector which is an example electronic unit to which a liquid-crystal display device of the present invention is applied.

A projector in which the liquid-crystal display device is used as a light valve will be described first. FIG. 24 is a plan showing an example structure of the projector. As shown in the figure, the projector 1100 is provided in its inside with a lamp unit 1102 having a white light source such as a metal halide lamp. Projection light emitted from the lamp unit 1102 is separated into three primary colors, red (R), green (G), and blue (B), by four mirrors 1106 and two dichroic mirrors 1108 disposed in a light guide 1104, and they are incident on liquid-crystal panels 1110R, 1110B, and 1110G serving as light valves corresponding to the primary colors.

The liquid-crystal panels 1110R, 1110B, and 1110G have a structure similar to that of the liquid-crystal display panel 100A or 100B described above, and are driven by R, G, and B primary-color signals sent from an image-signal processing circuit (not shown). Light modulated by these liquid-crystal panels is incident on a dichroic prism 1112 in three directions. In the dichroic prism 1112, red light and blue light refract at 90 degrees whereas green light goes straight. Therefore, images having the colors are synthesized, and a color image is projected on a screen through a projection lens 1114.

Since light corresponding to the primary colors R, G, and B is incident on the liquid-crystal panels 1110R, 1110B, and 1110G by the dichroic mirrors 1108, there is no need to provide the opposite substrates with color filters.

Figure 25:
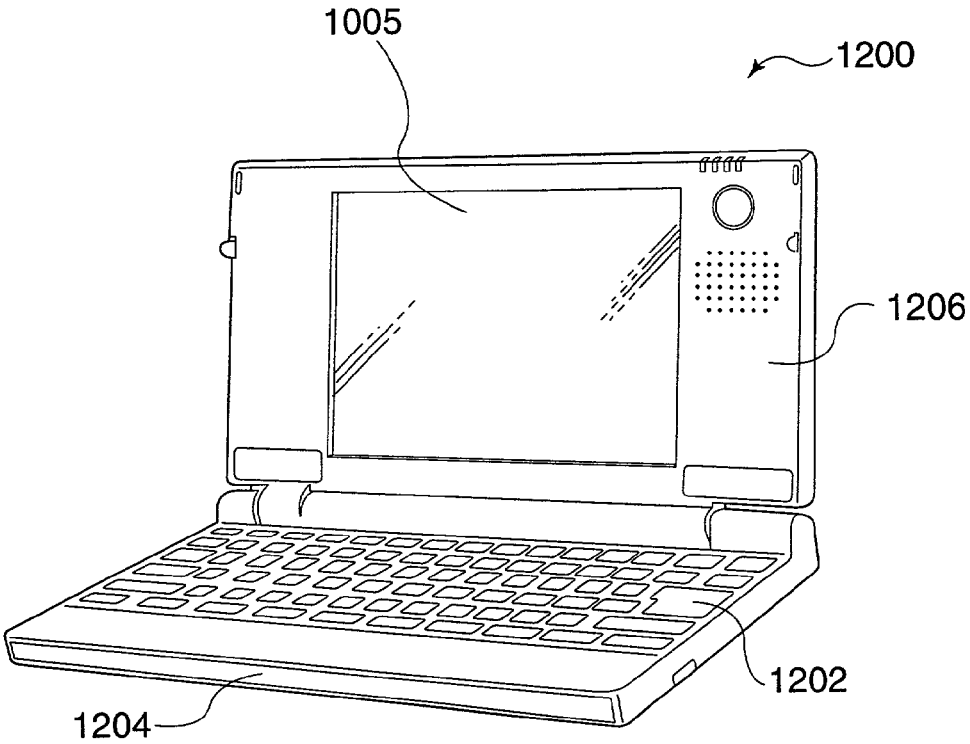
FIG. 25 is a perspective view showing the structure of a personal computer which is an example electronic apparatus to which a liquid-crystal display apparatus of the present invention is applied.

A case in which the liquid-crystal display device is applied to a mobile computer will be described next. FIG. 25 is an elevation view showing the structure of the computer. In the figure, the computer 1200 includes a body section 1204 provided with a keyboard 1202, and a liquid-crystal display 1206. The liquid-crystal display 1206 is formed by adding a backlight at the rear of the liquid-crystal display panel 100A or 100B, described before.

Figure 26:
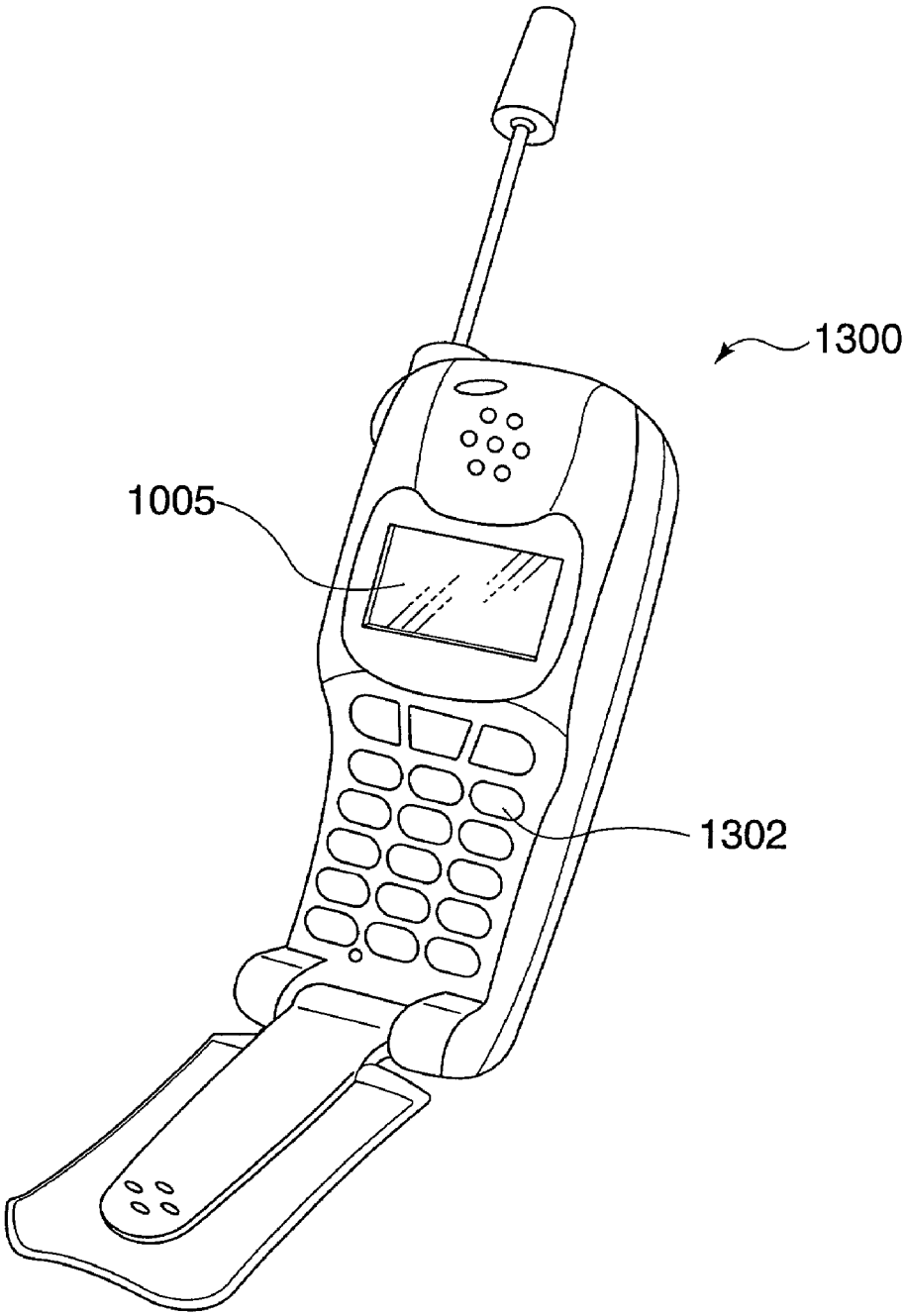
FIG. 26 is a perspective view showing the structure of a portable telephone which is an example electronic apparatus to which a liquid-crystal display apparatus of the present invention is applied.
Figure 27:
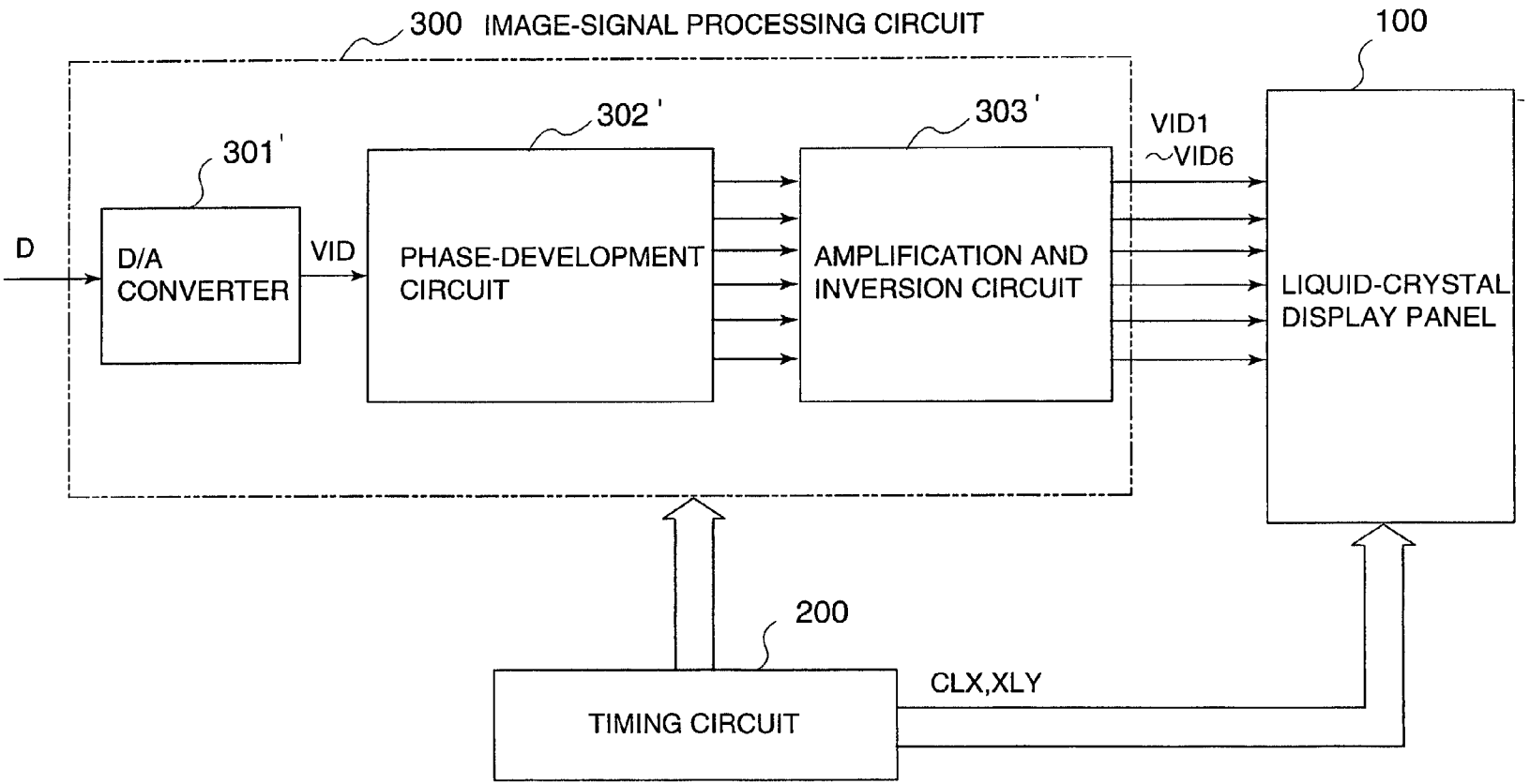
FIG. 27 is a block diagram showing the entire structure of a conventional liquid-crystal display device.
Figure 28:
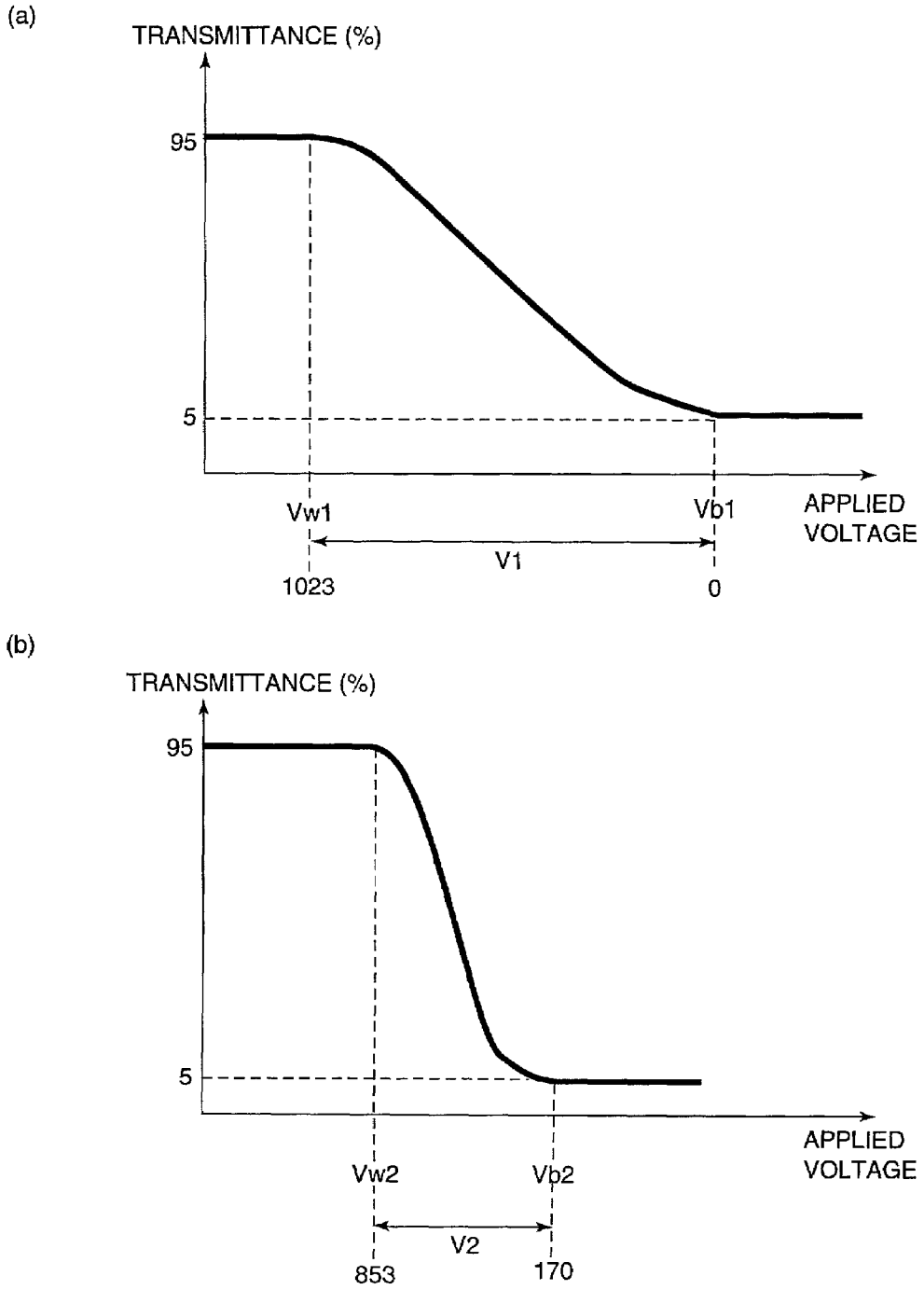
FIG. 28(*a*) is a view showing an example V-T characteristic of a liquid-crystal display panel used in the conventional liquid-crystal display device.

A case in which the liquid-crystal display device is applied to a portable telephone will be described next. FIG. 26 is a perspective view showing the structure of the portable telephone. In the figure, the portable telephone 1300 is provided with a plurality of operation buttons 1302 and a reflective liquid-crystal panel 1005. A front light is provided for the reflective liquid-crystal panel 1005 at its front, if necessary.

In addition to the electronic apparatuses described by referring to FIG. 24 to FIG. 26, liquid-crystal TV sets, view-finder-type and monitor-view-type video cassette tape recorders, car navigation apparatuses, pagers, electronic pocketbooks, electronic calculators, word processors, workstations, video telephones, POS terminals, apparatuses having a touch-sensitive panel, and the like can be given. It should be understood that the present invention can also be applied to these various types of electronic apparatuses.

As described above, according to the present invention, since a range where the signal level of an image signal is changed can be adjusted according to the type of an electro-optical panel used, the range of voltages applied to an electro-optical material can be adjusted according to various V-T characteristics. As a result, it is always possible to maximize the panel's performance.

According to the present invention, a range of applied voltages to which the data values of input image data are assigned can be changed according to the type of input image data. Therefore, high-definition images can be displayed.

According to the present invention, a range of applied voltages to which the data values of input image data are assigned can be changed according to the mean gray scale value of an image. Therefore, high-definition images can be displayed.

While this invention has been described in conjunction with the specific embodiments thereof, it is evident that many alternatives, modifications and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An image processing circuit, comprising:

a control-signal generating device that generates a control signal indicating a type of an electro-optical panel used in combination with the image processing circuit;

a D/A conversion device that converts input image data from a digital signal to an analog signal to generate an image signal and that adjusts a range where a signal level of the image signal is changed, according to the control signal; and a processing device that generates an output image signal to be sent to the electro-optical panel, according to the image signal, the processing device further comprising:

an image-signal inversion section that inverts a signal polarity of the image signal at an inversion period determined in advance, with a certain potential being used as a reference while amplifying the image signal to generate an inverted image signal;

a reference-signal generating section that generates a first reference voltage and a second reference voltage according to the control signal, and that alternately selects one of the first reference voltage and the second reference voltage at the inversion period to generate a reference signal; and an output-image-signal generating section that synthesizes the inverted image signal with the reference signal to generate the output image signal.

2. An image processing circuit according to claim 1, the reference-signal generating section further comprising:

a power-supply section that generates a positive-polarity reference voltage higher than a reference potential determined in advance according to the type of the electro-optical panel by a minimum applied voltage, and that generates a negative-polarity reference voltage lower than the reference potential by the minimum applied voltage;

a first selection section that selects a voltage corresponding to the electro-optical panel used in combination with the image processing circuit among the positive-polarity reference voltages, according to the control signal to generate the first reference voltage, and that selects a voltage corresponding to the electro-optical panel used in combination with the image processing circuit among the negative-polarity reference voltages, according to the control signal to generate the second reference voltage; and a second selection section that alternately selects one of the first reference voltage and the second reference voltage at the inversion period to generate the reference signal; and wherein the minimum applied voltage is specified for each electro-optical panel, and is the lowest voltage required to be applied to the electro-optical material of the electro-optical panel to obtain a range of transmittance used for displaying images.

3. An image processing circuit according to claim 2, the minimum applied voltage being a voltage corresponding to a saturation transmittance of the electro-optical material.

4. An image processing circuit according to claim 2, the power-supply section comprising:

a first voltage source that generates a first voltage higher than a reference potential determined in advance according to the type of the electro-optical panel by a maximum applied voltage;

a second voltage source that generates a second voltage lower than the reference potential by the maximum applied voltage;

a subtraction section that subtracts a change voltage determined in advance according to the type of the electro-optical panel from the first voltage to generate the positive-polarity reference voltage; and an adder section that adds the change voltage to the second voltage to generate the negative-polarity reference voltage; and wherein the maximum applied voltage is the highest voltage required to be applied to the electro-optical material to obtain a range of transmittance used to display images, according to the type of the electro-optical panel.

5. An electro-optical device, comprising:

an image processing circuit according to claim 1; and an electro-optical panel having an electro-optical material in which a transmittance of the electro-optical material is changed according to an applied voltage, and receiving the output image signal.

6. An electro-optical device according to claim 5, the electro-optical panel further comprising:

a device substrate including a plurality of data lines, a plurality of scanning lines, switching devices disposed at the intersections of the plurality of data lines and the plurality of scanning lines, and pixel electrodes connected to the switching devices;

an opposing substrate having an opposing electrode; and an electro-optical material sandwiched by the device substrate and the opposing substrate, the reference potential being the potential of the opposing electrode, and the output image signal being sequentially sent to the plurality of data lines.

7. An electronic apparatus comprising an electro-optical device according to claim 5.

8. A projection-type display apparatus, comprising:

a light source;

an electro-optical device according to claim 5 that modulates light emitted from the light source; and a projection-lens system that projects light emitted from the electro-optical device.

9. An image processing circuit according to claim 1, further comprising:

a phase-development circuit that applies phase development to the image signal whose range is adjusted by the D/A conversion device, to generate phase-development image signals.

10. An image processing circuit according to claim 1, the processing device generating the output image signal according to a voltage-transmittance characteristic of the electro-optical panel.

11. An image processing circuit according to claim 1, the image processing circuit being capable of being used with a plurality of different types of panels, the electro-optical panel used in combination with the image processing circuit being one of the plurality of different types of panels.

12. An image processing method that generates an output image signal to be sent to one type of electro-optical panel selected from among a plurality of types of electro-optical panels determined in advance and having electro-optical materials in which their transmittances are changed according to an applied voltage, the image processing method comprising the steps of:

converting image input data from a digital signal to an analog signal to generate an image signal, and adjusting a range where the signal level of the image signal is changed, according to the type of the electro-optical panel;

inverting the signal polarity of the image signal with a certain potential being used as a reference at an inversion period determined in advance while amplifying the image signal to generate an inverted image signal;

alternately selecting one of a positive-polarity reference voltage higher than a reference potential determined in advance according to the type of the electro-optical panel by a minimum applied voltage, and a negative-polarity reference voltage lower than the reference potential by the minimum applied voltage, at the inversion period to generate a reference signal; and synthesizing the inverted image signal and the reference signal to generate the output image signal;

wherein the minimum applied voltage is specified for each electro-optical panel, and is the lowest voltage required to be applied to the electro-optical material to obtain a range of the transmittance to be used to display images.

* * * * *